US007251954B2

(12) United States Patent
Fee et al.

(10) Patent No.: US 7,251,954 B2
(45) Date of Patent: Aug. 7, 2007

(54) MODULAR REFRIGERATION UNIT AND REFRIGERATOR

(75) Inventors: Bryan Fee, Toronto (CA); Russell Sherlock, Toronto (CA); Larlkyn Lee, Willowdale (CA); Marinko Tepic, Don Mills (CA); Scott Brown, Uxbridge (CA)

(73) Assignee: Habco Beverage Systems Inc., North York, ON (CA)

( * ) Notice: Subject to any disclaimer, the term of this patent is extended or adjusted under 35 U.S.C. 154(b) by 373 days.

(21) Appl. No.: 10/687,749

(22) Filed: Oct. 20, 2003

(65) Prior Publication Data

US 2004/0134221 A1 Jul. 15, 2004

Related U.S. Application Data

(60) Provisional application No. 60/419,105, filed on Oct. 18, 2002.

(51) Int. Cl.
*F25D 19/02* (2006.01)

(52) U.S. Cl. ..... 62/448; 62/298

(58) Field of Classification Search ..... 62/440, 62/443, 447, 448, 298, 450, 515
See application file for complete search history.

(56) References Cited

U.S. PATENT DOCUMENTS

| | | | | |
|---|---|---|---|---|
| 3,712,078 | A | 1/1973 | Maynard et al. | |
| 3,805,545 | A * | 4/1974 | Buchser et al. | 62/443 |
| 4,416,122 | A | 11/1983 | Johnson | |
| 4,457,140 | A | 7/1984 | Rastelli | |
| 4,490,990 | A | 1/1985 | Chastine et al. | |
| 4,509,335 | A | 4/1985 | Griffin et al. | |
| 4,730,750 | A | 3/1988 | Ficken | |
| 4,870,735 | A * | 10/1989 | Jahr et al. | 29/890.35 |
| 5,086,627 | A | 2/1992 | Borgen | |
| 5,199,273 | A * | 4/1993 | Silva et al. | 62/298 |
| 5,284,023 | A | 2/1994 | Silva et al. | |
| 5,347,827 | A | 9/1994 | Rudick et al. | |
| 5,402,654 | A | 4/1995 | Rudick et al. | |
| 5,417,079 | A | 5/1995 | Rudick et al. | |
| 5,417,081 | A | 5/1995 | Rudick et al. | |
| 5,433,082 | A | 7/1995 | Trulaske | |
| 5,458,407 | A | 10/1995 | Bustos et al. | |
| 5,461,878 | A | 10/1995 | Moore et al. | |
| 5,551,250 | A * | 9/1996 | Yingst et al. | 62/234 |
| 5,678,421 | A | 10/1997 | Maynard et al. | |
| 5,732,565 | A * | 3/1998 | Ramakrishnan et al. | 62/298 |
| D410,353 | S | 6/1999 | Rand et al. | |
| 5,953,929 | A | 9/1999 | Bauman et al. | |
| 5,966,958 | A | 10/1999 | Maynard et al. | |
| 6,070,424 | A | 6/2000 | Bauman et al. | |
| 6,094,934 | A | 8/2000 | Rand et al. | |
| 6,094,950 | A | 8/2000 | Maynard et al. | |
| 6,170,285 | B1 | 1/2001 | Huffman et al. | |
| 6,378,313 | B2 | 4/2002 | Barrash | |
| 6,378,324 | B1 | 4/2002 | Percy et al. | |
| 6,464,312 | B1 * | 10/2002 | Tenhundfeld et al. | 312/405 |

* cited by examiner

*Primary Examiner*—Melvin Jones

(57) ABSTRACT

A modular refrigeration unit has a condenser assembly, an evaporator assembly, and a bulkhead assembly positioned between the condenser assembly and the evaporator assembly. The refrigeration cabinet includes a condenser chamber adapted for receiving the condenser assembly. The condenser chamber has an insulated wall portion with a mating surface thereon. The refrigeration cabinet also has an insulated main chamber, in which air is cooled by the evaporator assembly. The bulkhead assembly is engageable with the mating surface to form a substantially air-tight seal between the condenser chamber and the main chamber.

28 Claims, 44 Drawing Sheets

MODULAR REFRIGERATION UNIT AND REFRIGERATOR

FIELD OF THE INVENTION

This invention relates to modular refrigeration units and refrigerators including modular refrigeration units.

BACKGROUND OF THE INVENTION

In certain known refrigerators, a condenser, a compressor, and an evaporator are individually built into a refrigeration cabinet. In these refrigerators, removal of any one of the condenser, the compressor, or the evaporator for maintenance or replacement would result in significant downtime. Also, a highly-skilled refrigeration technician would be required to attend at the refrigerator, resulting in significant maintenance costs. Accordingly, refrigeration units are known in which the condenser, the compressor and the evaporator are positioned on a base, for relatively easier installation and removal. For example, a refrigeration unit of the prior art is disclosed in U.S. Pat. No. 5,953,929 (Bauman et al.).

Refrigerators of the evaporation type are known in which a known refrigeration unit is installed in the refrigeration cabinet and the refrigeration unit is insulated by insulated wall segments. Typically, the refrigeration cabinet includes a condenser chamber (in which the condenser and the compressor are located) which is in fluid communication with the ambient atmosphere, and an insulated cabinet chamber. An evaporator is typically located in the cabinet chamber, to cool air in the cabinet chamber.

Although removal and installation of the known refrigeration units is generally easier and faster than removal and replacement of individual components, known refrigeration units have some defects. In general, it is desirable that the refrigeration unit be as easily removable as possible to facilitate maintenance or repair. A substantially air-tight seal is needed between the condenser chamber and the cabinet chamber, to minimize heat transfer into the cabinet chamber. Because of the need for insulation of at least a portion of a refrigeration unit, installation of known refrigeration units in known refrigeration cabinets (and the removal thereof) typically requires the removal and addition of insulation separately. However, the removal and addition of insulation complicates the removal or installation (as the case may be) of the refrigeration unit. In addition, known refrigeration units typically do not include all the components needed for operation, further complicating removal or installation.

Also, depending on the user's requirements, the positioning of the refrigeration unit in the refrigeration cabinet may very. However. In the prior art, a refrigeration unit is specifically designed for use only in a particular position (e.g., top-mounted, or bottom-mounted: front-loaded or back- or side-loaded) in the refrigeration cabinet. Manufacturing different refrigeration units for different positions in the cabinet, as is known in the art, results in relatively high manufacturing costs per unit.

There is therefore a need for an improved refrigeration unit and an improved refrigerator.

SUMMARY OF THE INVENTION

In a broad aspect of the invention, there is provided a modular refrigeration unit with a condenser assembly, an evaporator assembly, and a bulkhead assembly positioned between the condenser assembly and the evaporator assembly. The refrigeration cabinet includes a condenser chamber adapted for receiving the condenser assembly. The condenser chamber has an insulated wall portion with a mating surface thereon. The refrigeration cabinet also has an insulated main chamber, in which air is cooled by the evaporator assembly. The bulkhead assembly is engageable with the mating surface to form a substantially air-tight seal between the condenser chamber and the main chamber.

In another aspect, there is provided a refrigerator including a refrigeration cabinet and a modular refrigeration unit installed therein. The refrigeration cabinet includes insulated outer walls and an access door(s) for accessing an insulated main chamber of the cabinet. The refrigeration cabinet also includes a condenser chamber extending inwardly from an aperture in an outer wall. The condenser chamber is partially defined by one or more interior wall portions with a mating surface thereon, the mating surface being positioned distal to the aperture. The modular refrigeration unit includes an evaporator assembly with an evaporator tray positioned beneath the evaporator, for collecting condensed moisture, and a condenser assembly with a condenser tray for collecting and dissipating moisture condensed on the evaporator and directed to the condenser tray. The modular refrigeration unit also has a bulkhead assembly positioned between the condenser assembly and the evaporator assembly, the bulkhead assembly having a peripheral edge. The peripheral edge of the bulkhead assembly is engageable with the mating surface to form a substantially air-tight seal between the condenser chamber and the main chamber.

In yet another aspect, the invention provides a refrigerator including an evaporator shield assembly positioned in the main chamber for channeling a circulatory air flow in the main chamber through the evaporator. The refrigerator also includes a plenum and a partition. The plenum is positioned adjacent to the evaporator, for guiding the circulatory air flow along a predetermined circulatory air flow path, and the partition is positioned substantially vertically in the main chamber for directing a substantial proportion of the circulatory air flow toward the evaporator.

In yet another alternative aspect, the invention provides a gasket assembly for use with a mating surface in a refrigeration cabinet. The gasket assembly includes a thermal breaker portion and a flexible gasket portion. The thermal breaker portion is adapted for attachment to a bulkhead body portion around a peripheral edge thereof. The gasket portion is attached to the thermal breaker portion, and is adapted to engage with a mating surface on one or more internal wall portion surfaces of the refrigeration cabinet to form a substantially air-tight seal.

BRIEF DESCRIPTION OF THE DRAWINGS

The invention will be better understood with reference to the drawings, in which.

DETAILED DESCRIPTION OF THE PREFERRED EMBODIMENT(S)

Figure 1A:
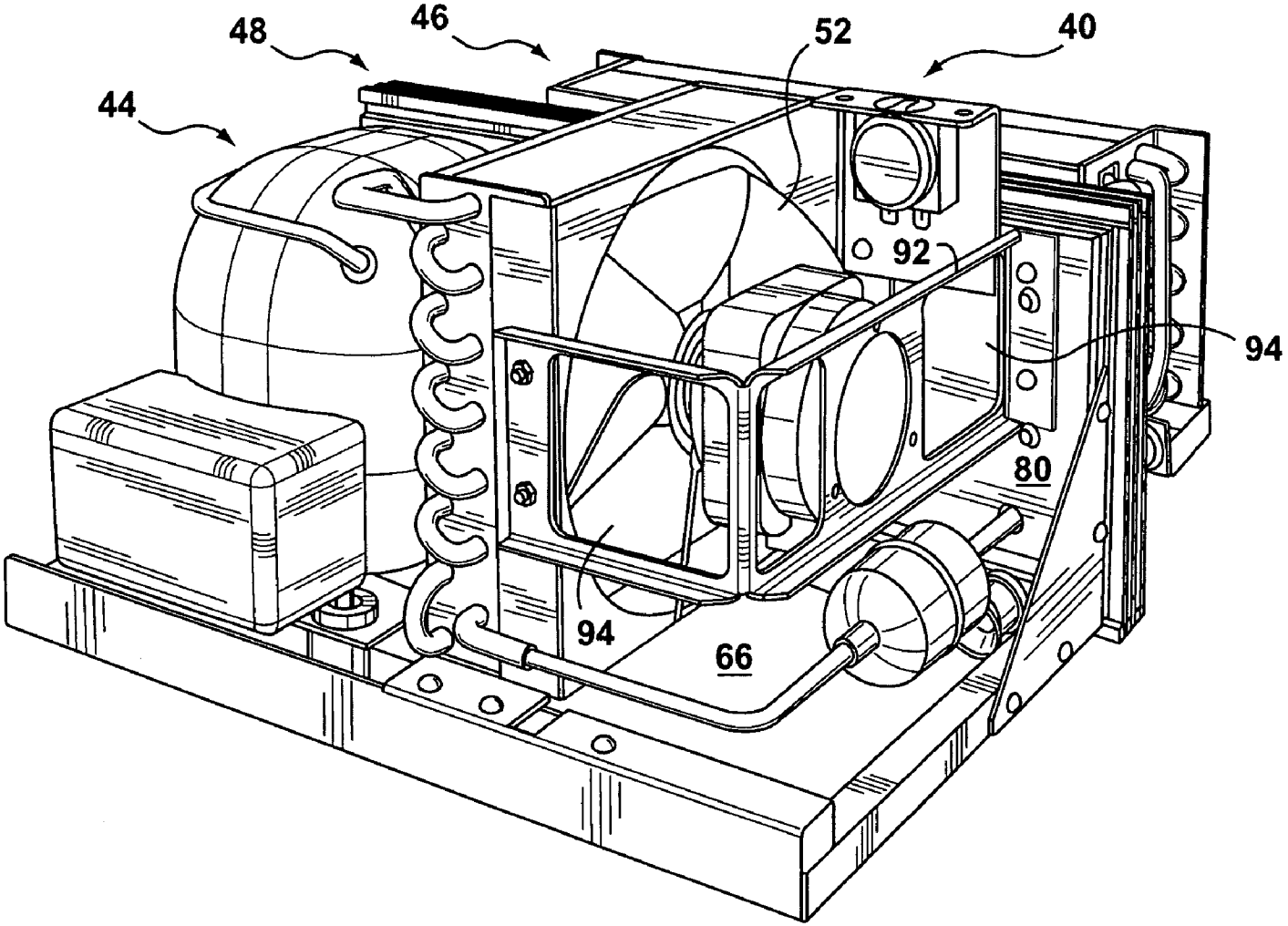
FIG. 1A is an isometric view of a preferred embodiment of a modular refrigeration unit of the invention, showing the top and front thereof.

Reference is first mad to FIGS. 1A-1E, 2-5, 6A, 6B, 7, 8A, and 8B to describe a preferred embodiment of a modular refrigeration unit indicated generally by the numeral 40 in accordance with the invention. The modular refrigeration unit 40 is for use in a refrigeration cabinet 42 (FIG. 6A). Preferably, the modular refrigeration unit 40 includes a condenser assembly 44, an evaporator assembly 46, and a bulkhead assembly 48 positioned between the condenser assembly 44 and the evaporator assembly 46.

Figure 5:
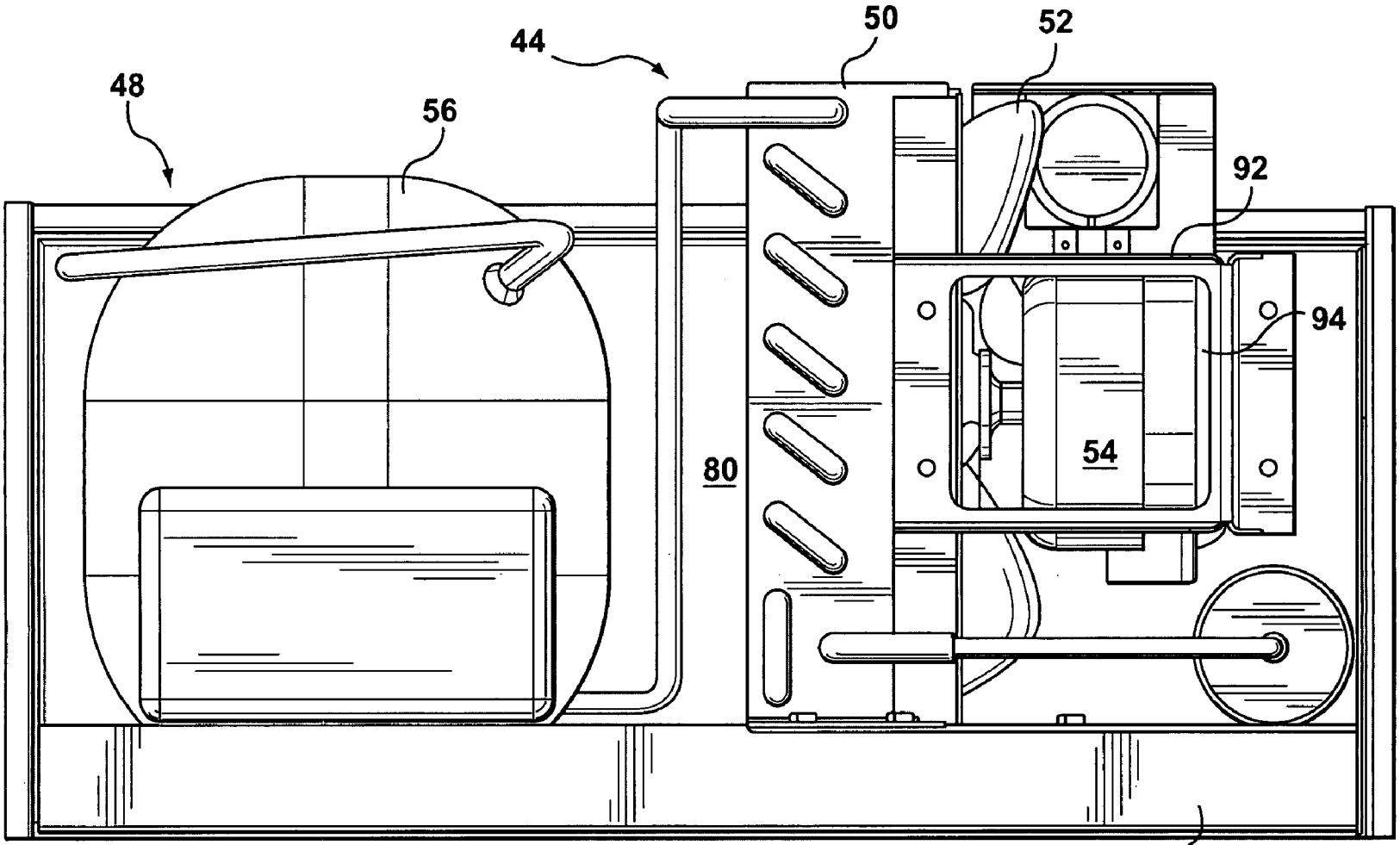
FIG. 5 is a front view of the modular refrigeration unit of FIG. 1A.
Figure 6A:
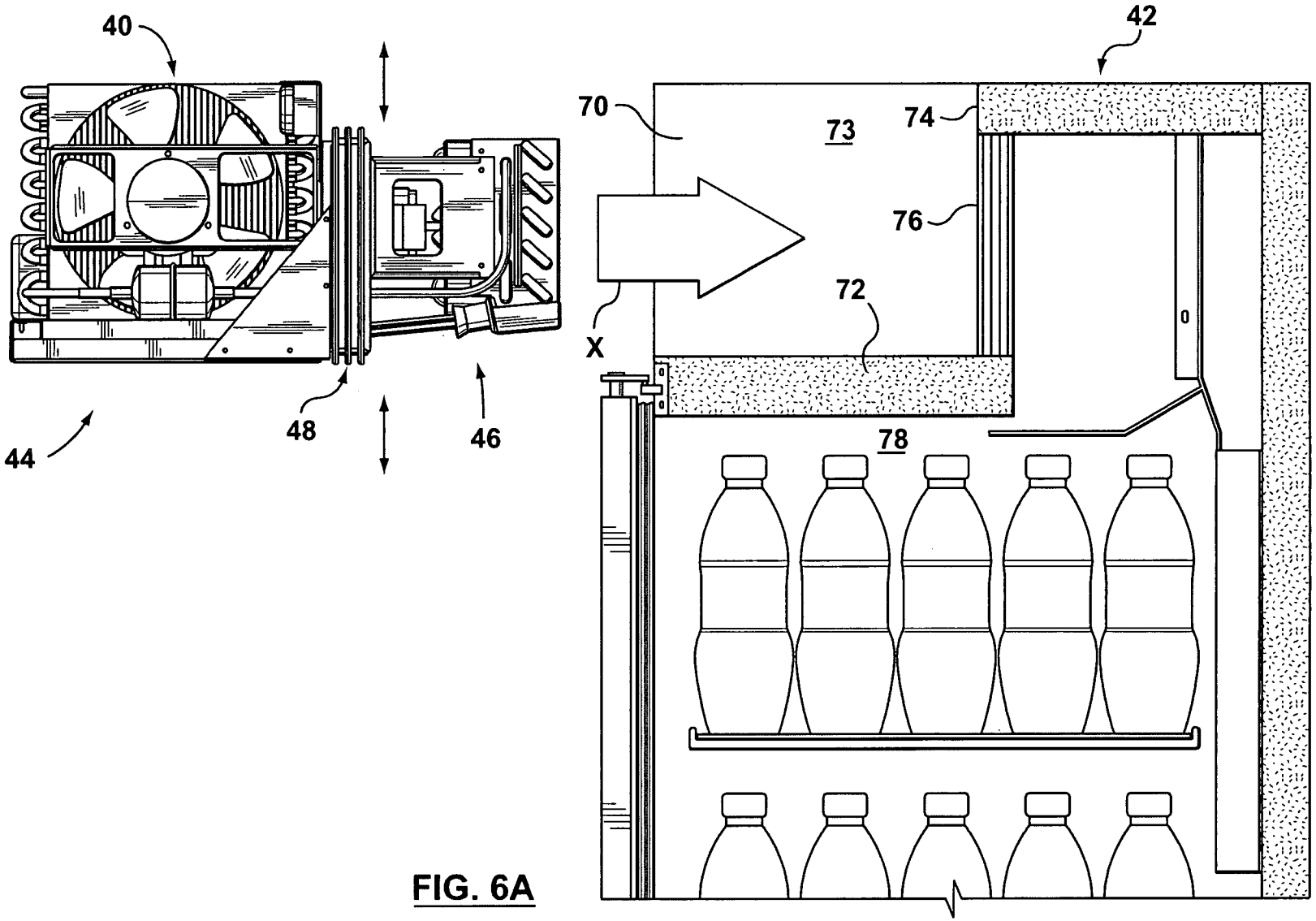
FIG. 6A is a partial cross-section of a preferred embodiment of a refrigeration cabinet, with the modular refrigeration unit of FIG. 1A positioned to be installed therein, drawn at a smaller scale.

The condenser assembly 44 includes a condenser 50 for condensing a refrigerant (not shown) in the condenser 50, as is known in the art (FIG. 5). In addition, the condenser assembly 44 includes a condenser fan 52 and a condenser fan motor 54 to drive the condenser fan 52. The condenser fan 52 is adapted for directing a flow of air through the condenser 50 to remove heat from the condenser 50, as will be described. As shown in FIG. 5, the condenser assembly 44 also includes a compressor 56 for compressing the refrigerant, as is also known in the art.

Figure 1B:
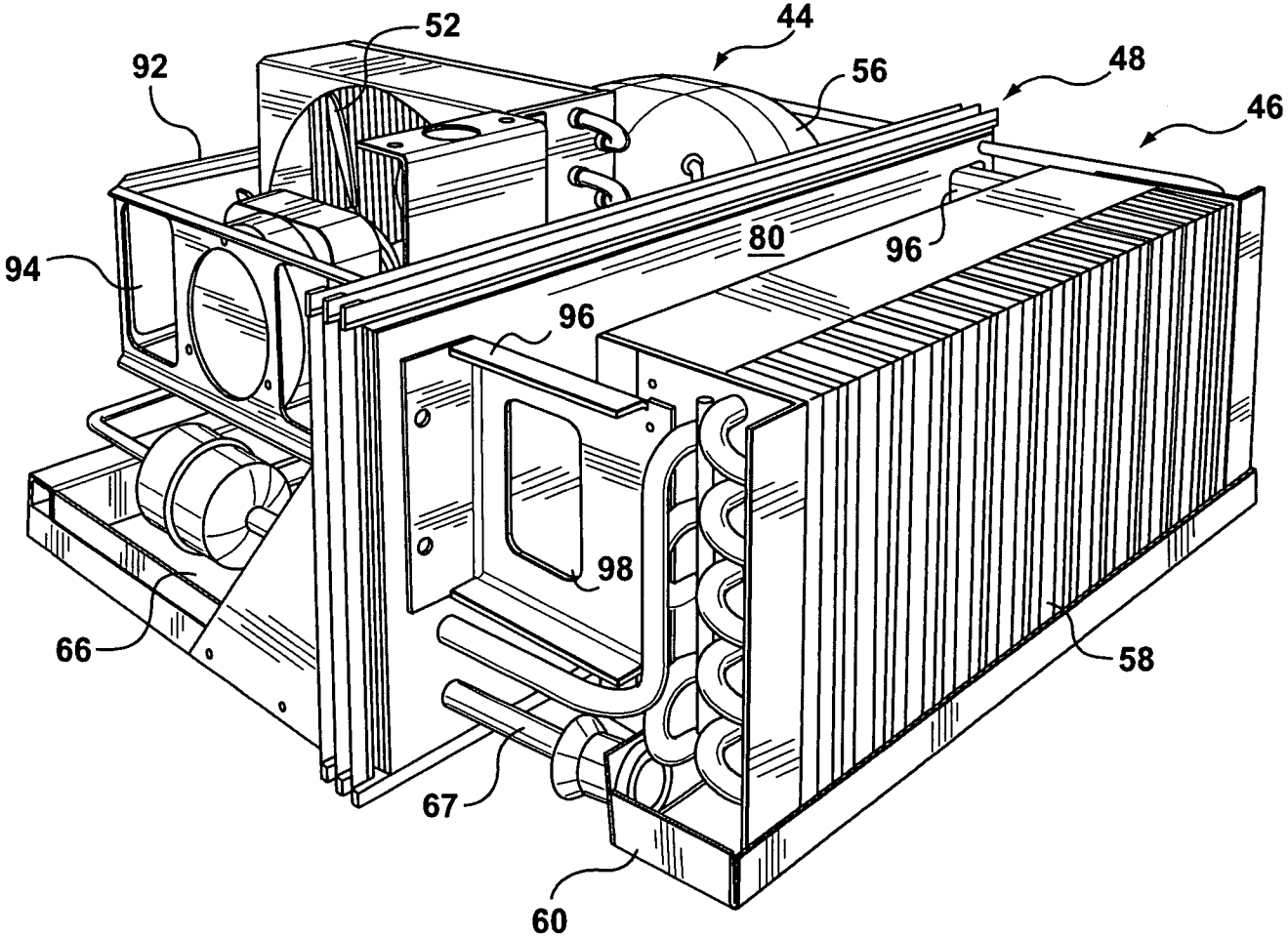
FIG. 1B is an isometric view from the top and back of the modular refrigeration unit of FIG. 1A, showing a right side thereof, drawn at a larger scale.
Figure 1C:
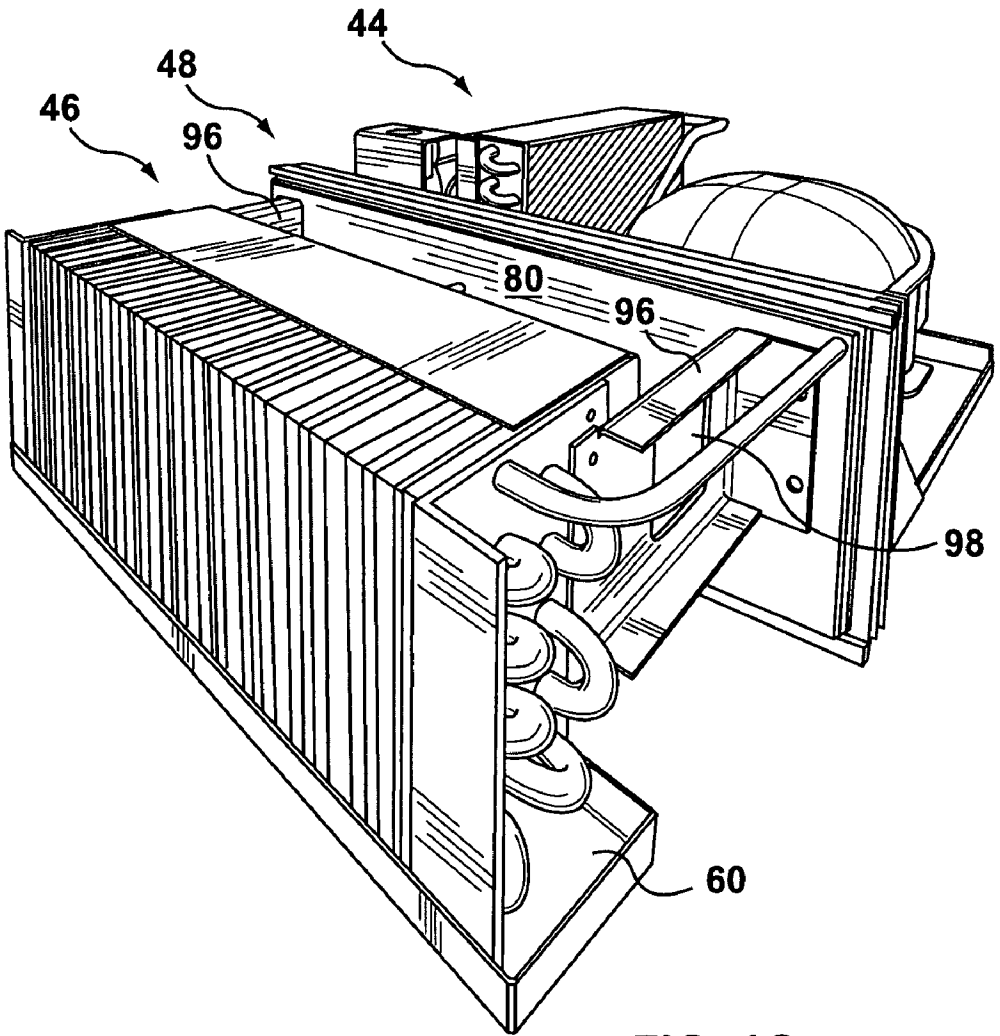
FIG. 1C is an isometric view from the top and back of the modular refrigeration unit of FIG. 1A, showing a left side thereof.
Figure 1D:
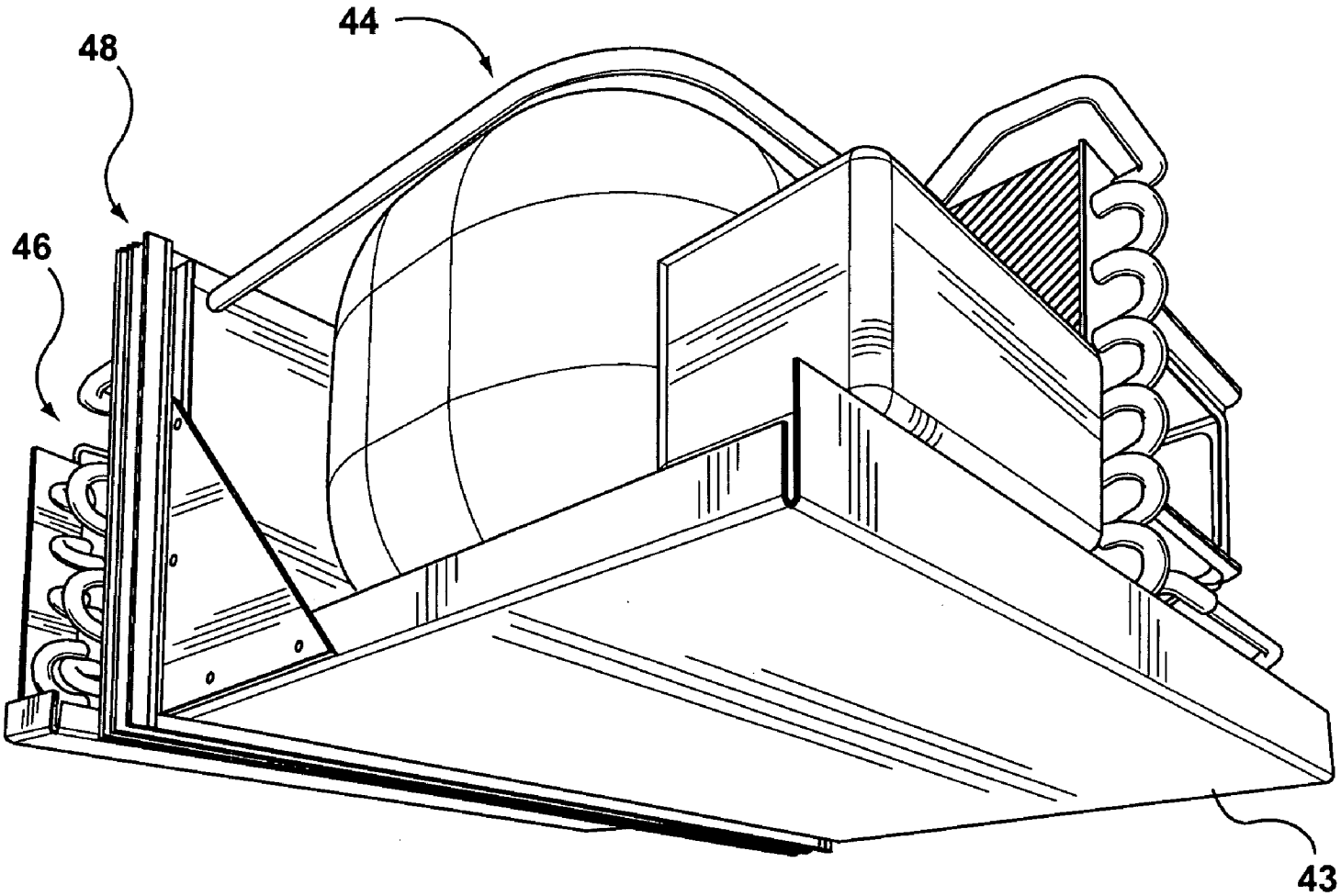
FIG. 1D is an isometric view from the bottom and front of the modular refrigeration unit of FIG. 1A, showing the left side thereof.
Figure 1E:
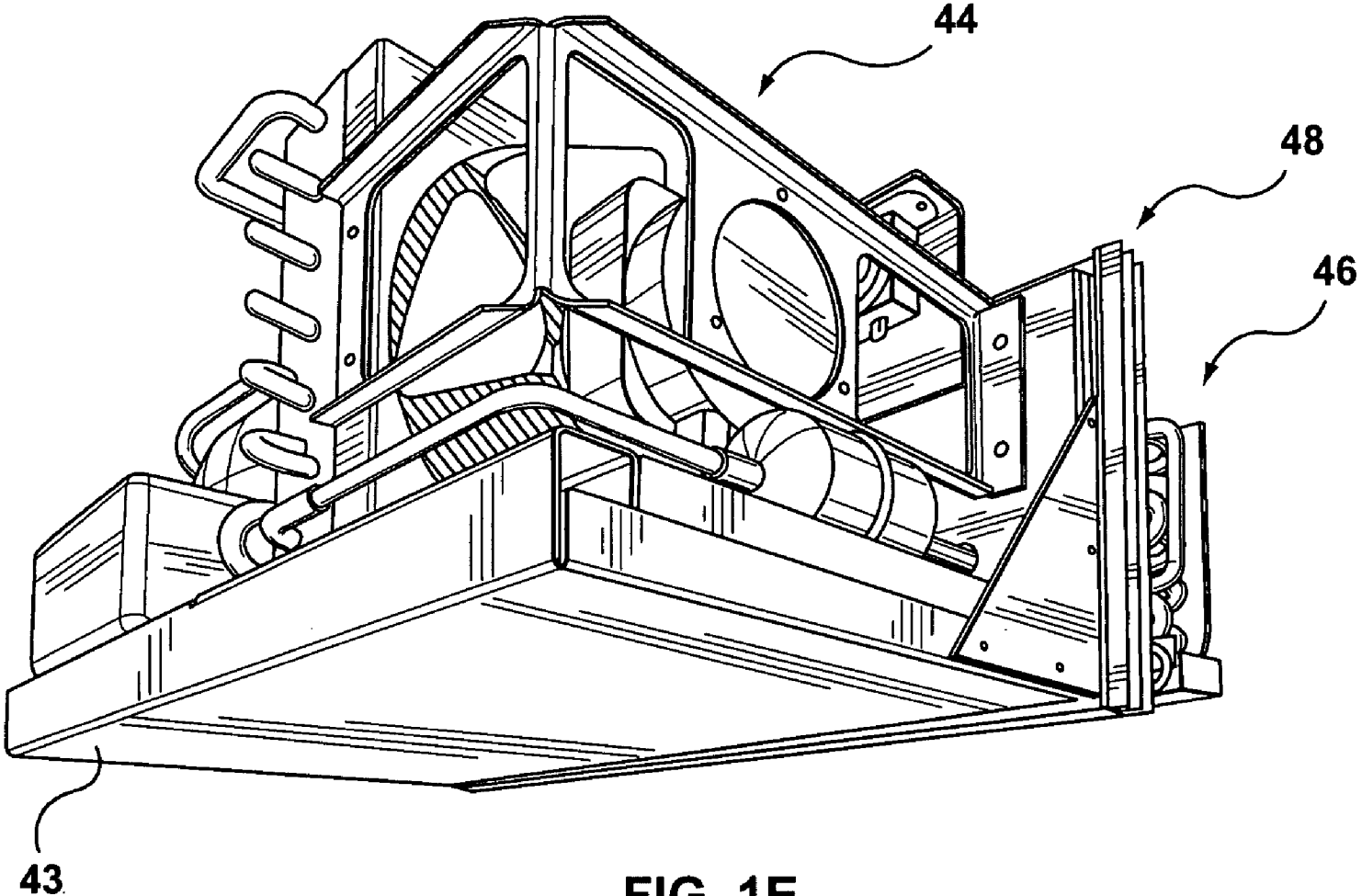
FIG. 1E is an isometric view from the bottom and back of the modular refrigeration unit of FIG. 1A, showing the right side thereof.
Figure 2:
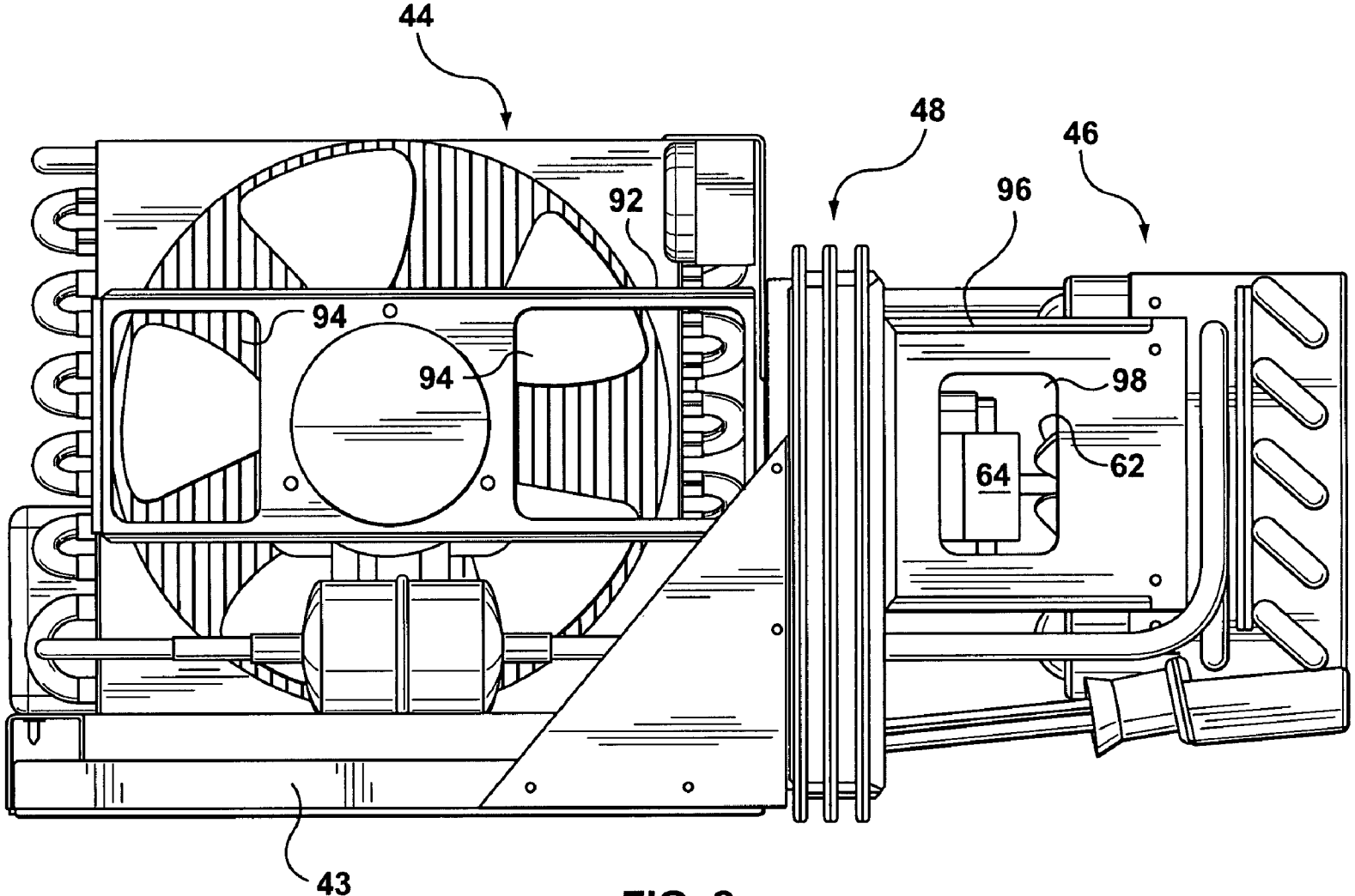
FIG. 2 is a side view of the right side of the modular refrigeration unit of FIG. 1A, drawn at a larger scale.
Figure 3:
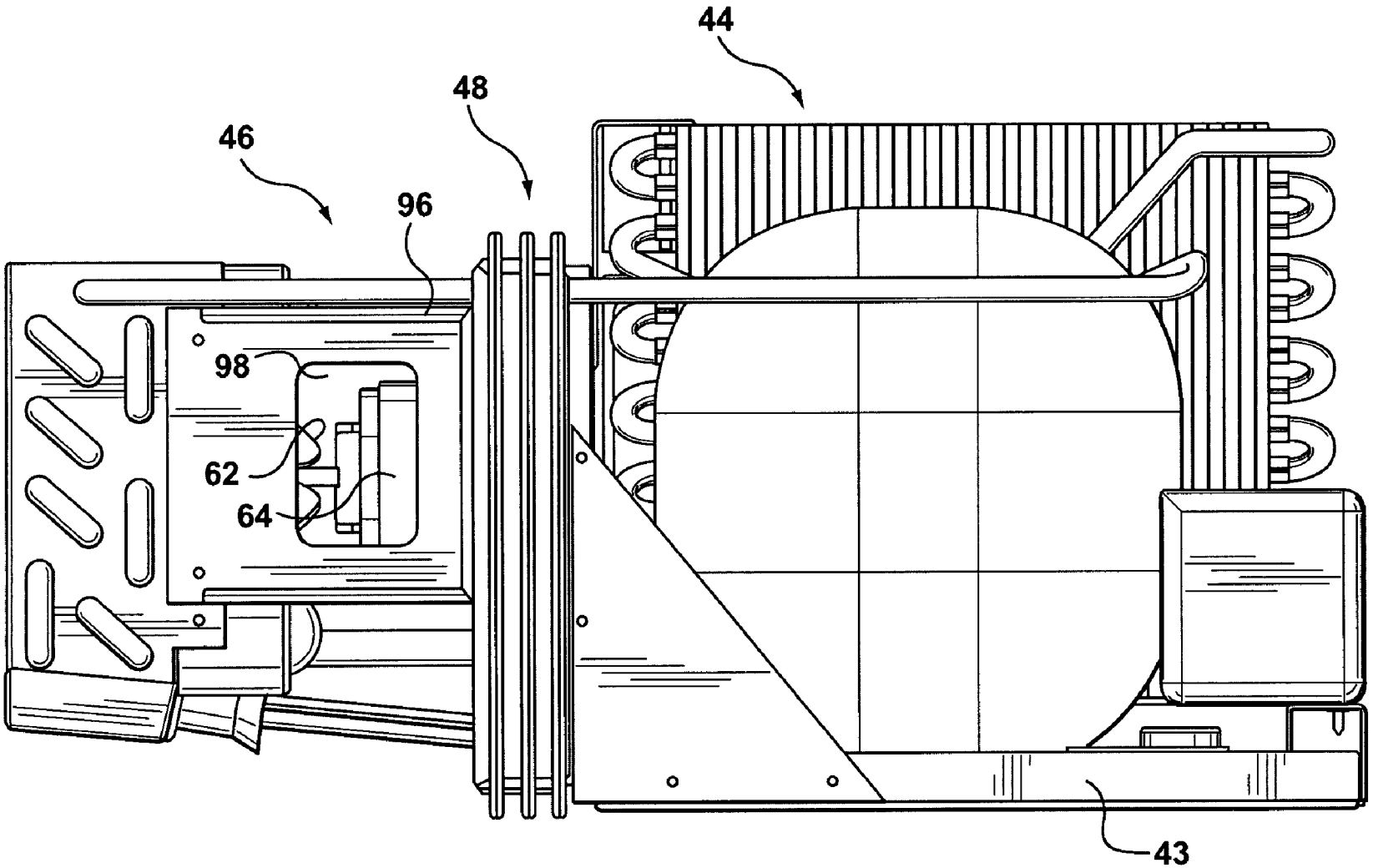
FIG. 3 is a side view of the left side of the modular refrigeration unit of FIG. 1A.
Figure 4:
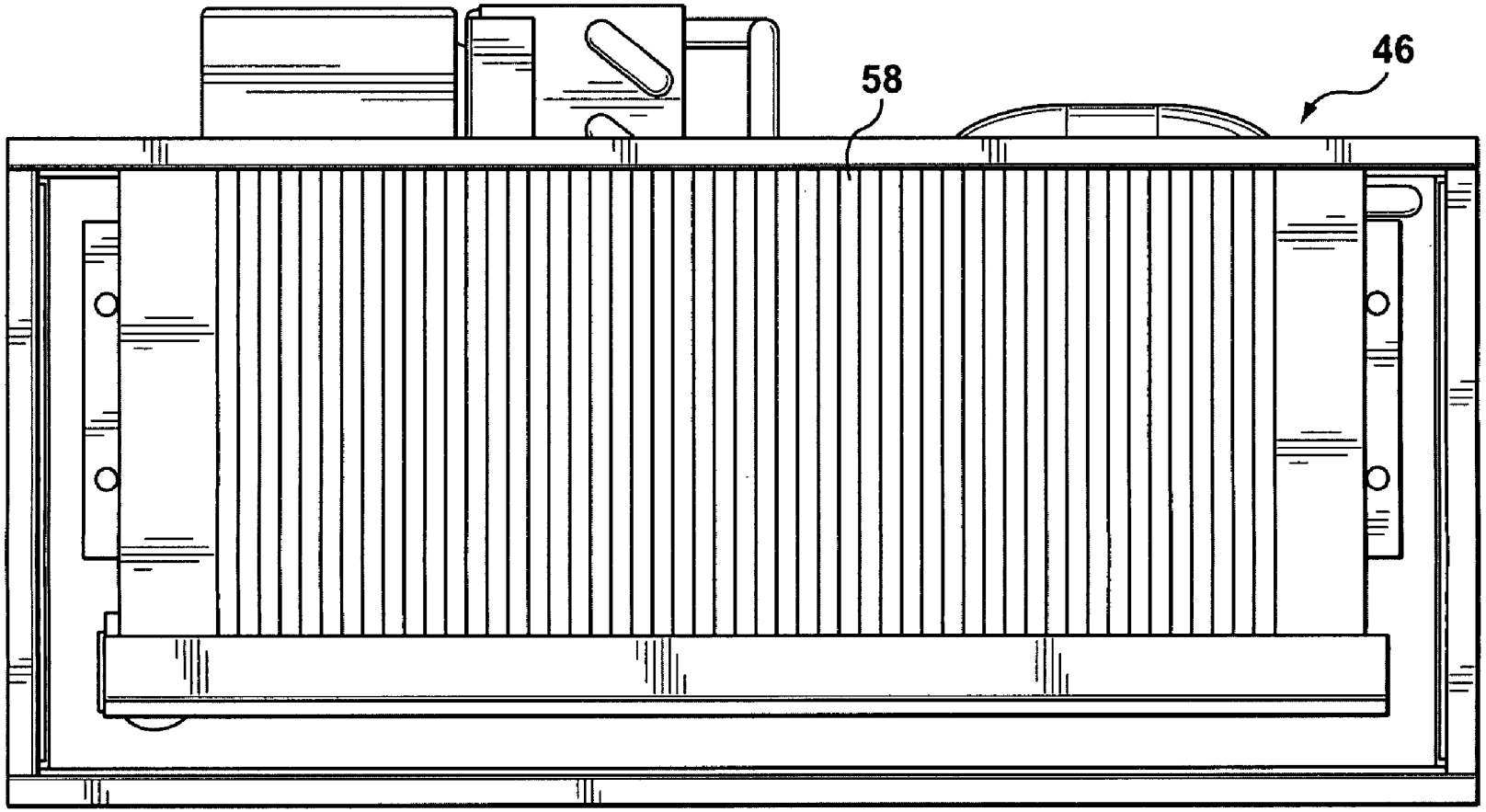
FIG. 4 is a back view of the modular refrigeration unit of FIG. 1A, drawn at a larger scale.

The evaporator assembly 46 includes an evaporator 58 for evaporating the refrigerant therein. Also included in the evaporator assembly 46 is an evaporator tray 60 positioned beneath the evaporator 58 for collecting moisture condensed on the evaporator 58 (FIGS. 1B, 1C). In addition, the evaporator assembly 46 includes an evaporator fan 62 and an evaporator fan motor 64 to drive the evaporator fan 62 (FIGS. 2, 3). The evaporator fan 62 is adapted for directing a flow of air through the evaporator 58, as will be described.

The condenser assembly 44 also includes a condenser tray 66 for collecting and dissipating moisture condensed on the evaporator 58 and directed to the condenser tray 66 (FIGS. 1B, 1C), as will be described. As can be seen in FIGS. 1A, 1B, and 2, condensed moisture is channelled, or directed, from the evaporator tray 60 to the condenser tray 66 via a conduit assembly 67. The evaporator tray 60 is positioned relative to the condenser tray 66 so that the moisture is moved through the conduit assembly 67 due to gravity.

Figure 6B:
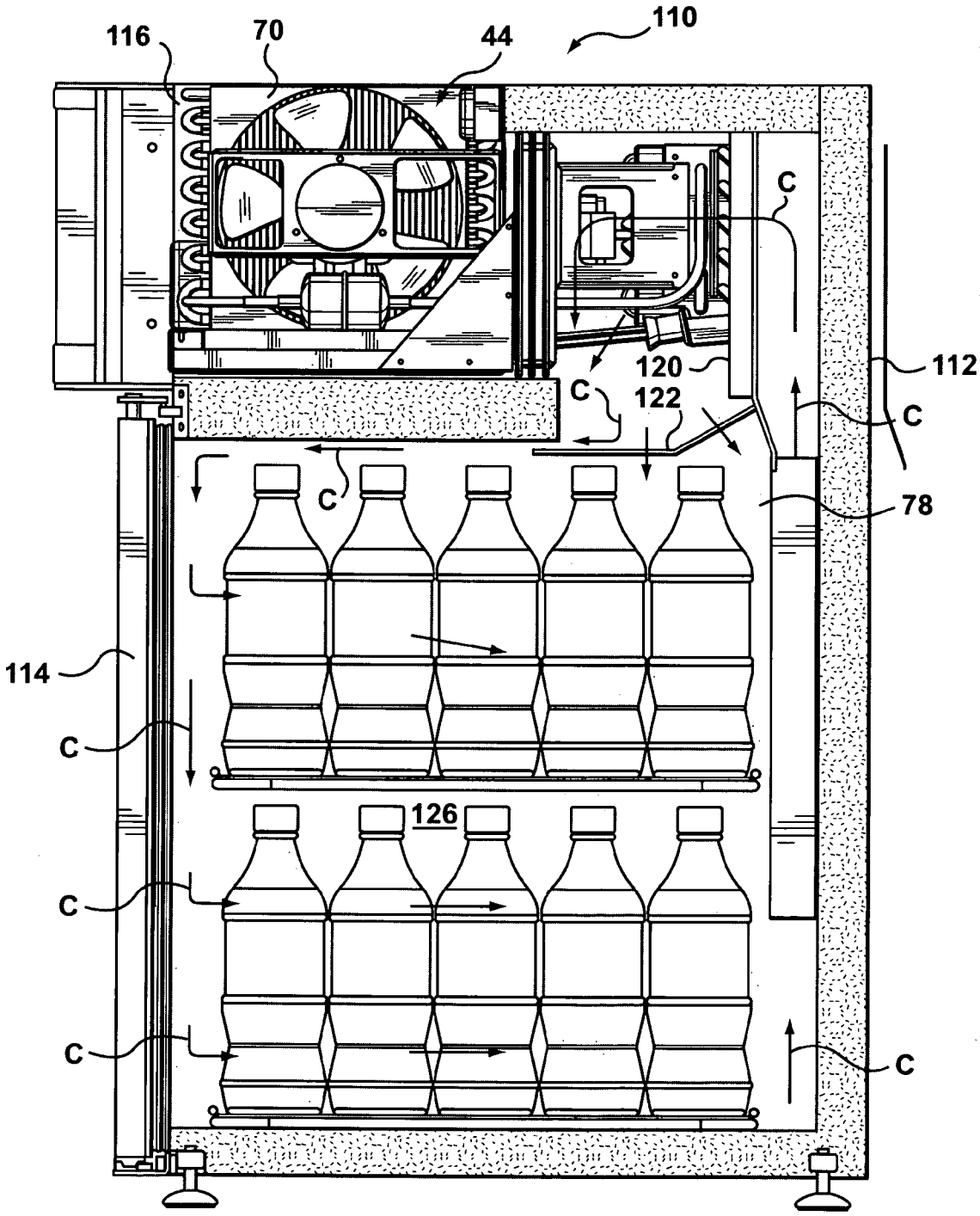
FIG. 6B is a cross-section of a preferred embodiment of a refrigerator with the modular refrigeration unit of FIG. 1A installed in the refrigeration cabinet of FIG. 6A.
Figure 16A:
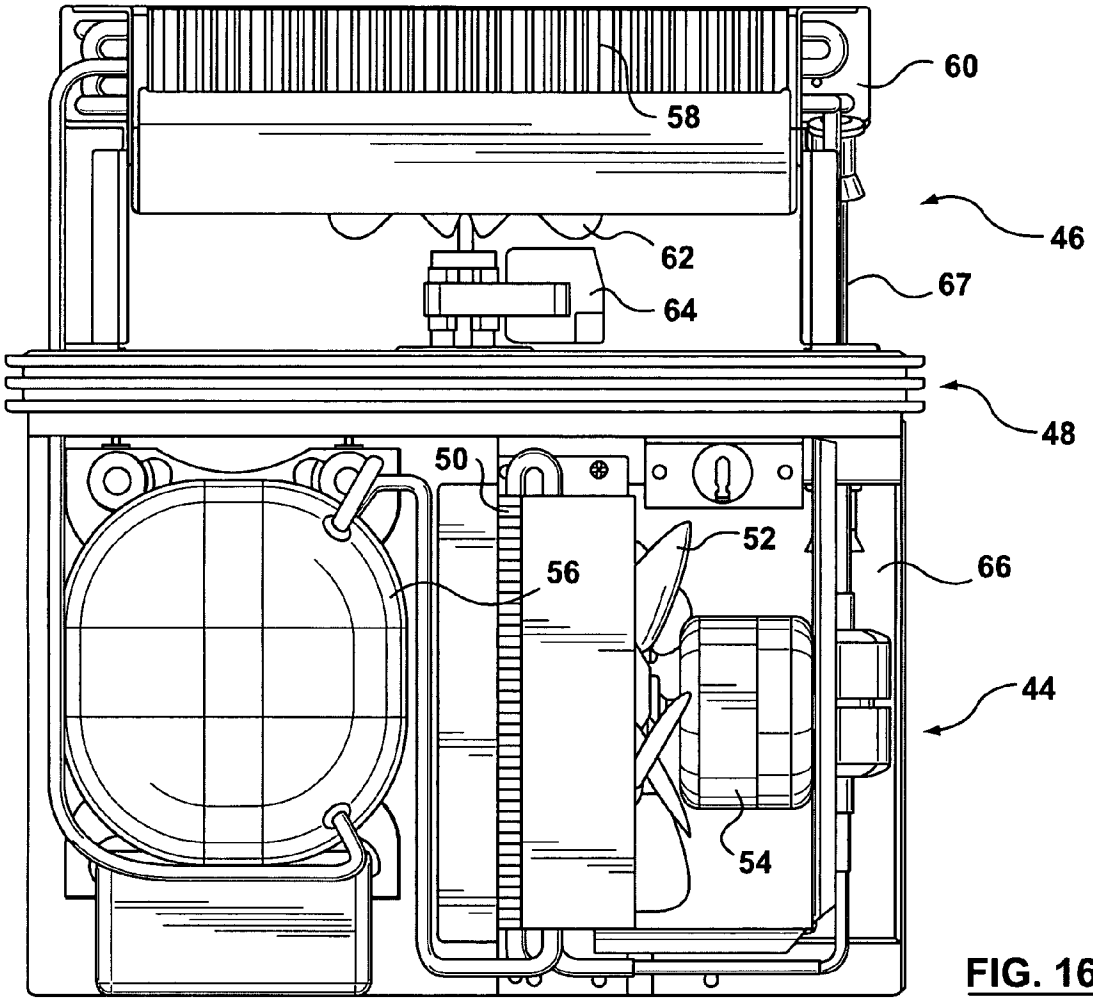
FIG. 16A is a top view of the modular refrigeration unit, drawn at a larger scale.
Figure 16B:
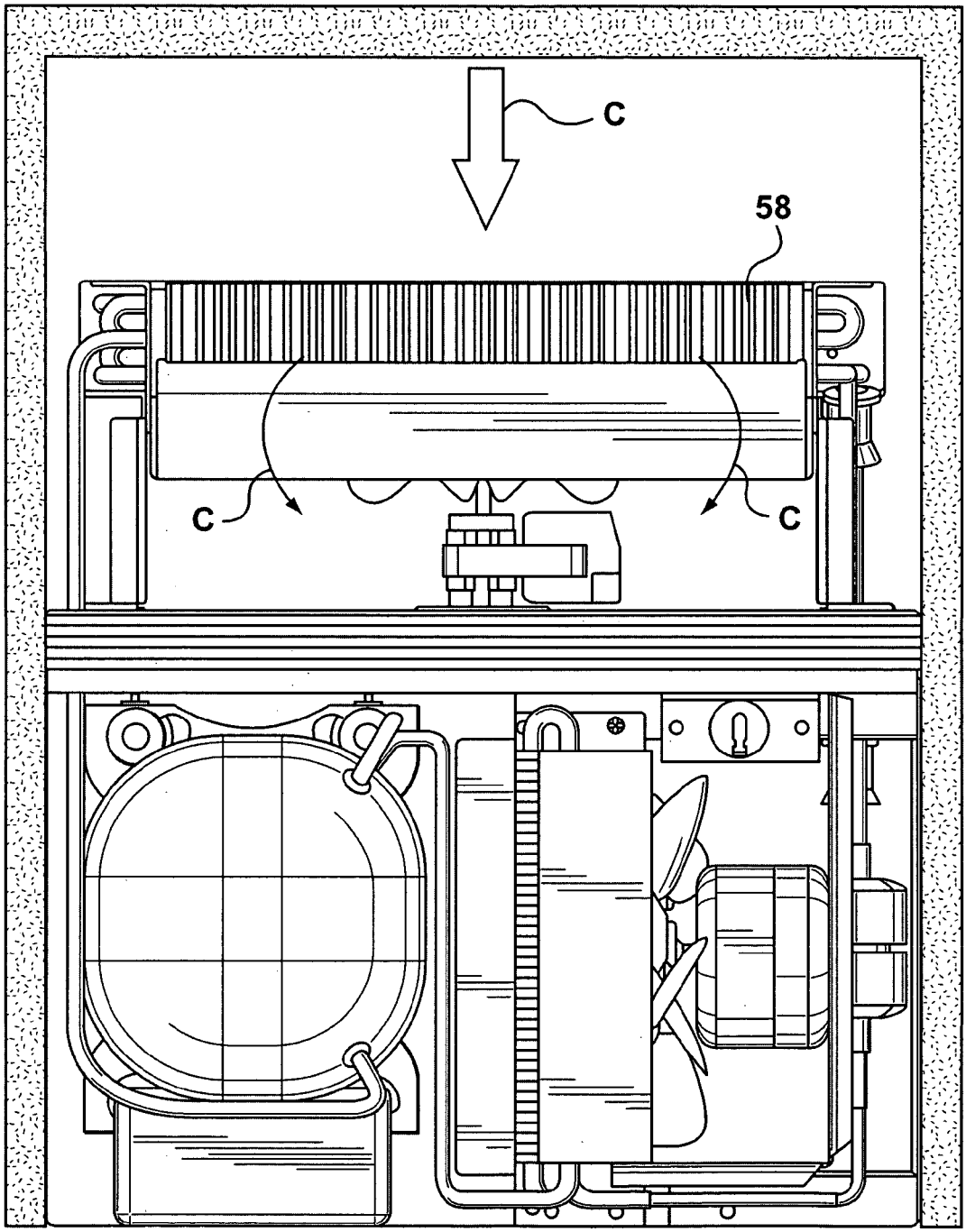
FIG. 16B is a top view of the preferred embodiment of the refrigerator showing the modular refrigeration unit, front-loaded and top-mounted, and a flow of air through the evaporator, drawn at a smaller scale.
Figure 17:
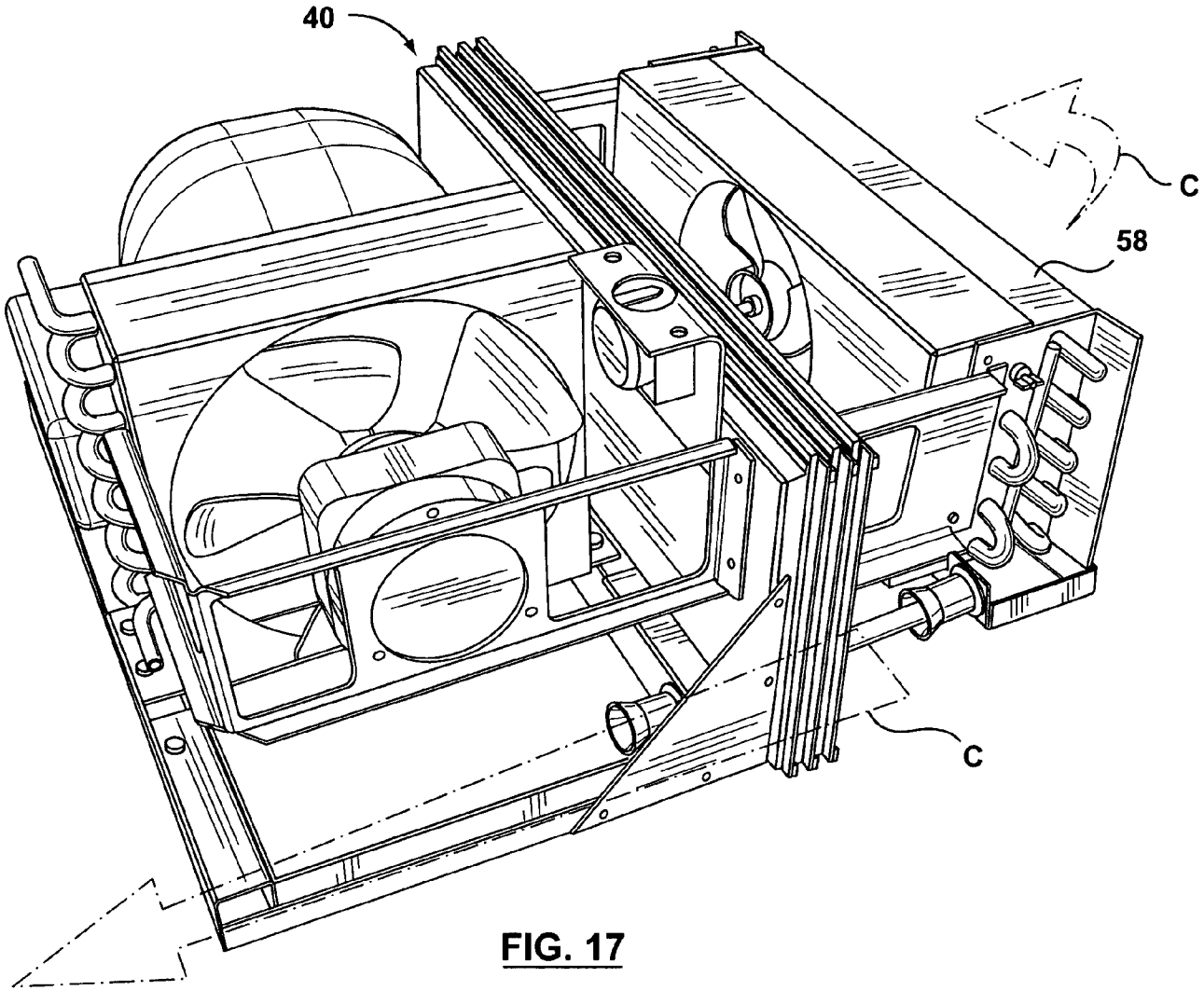
FIG. 17 is an isometric view of the modular refrigeration unit of FIG. 16B showing flow of air through the evaporator, drawn at a larger scale.
Figure 22A:
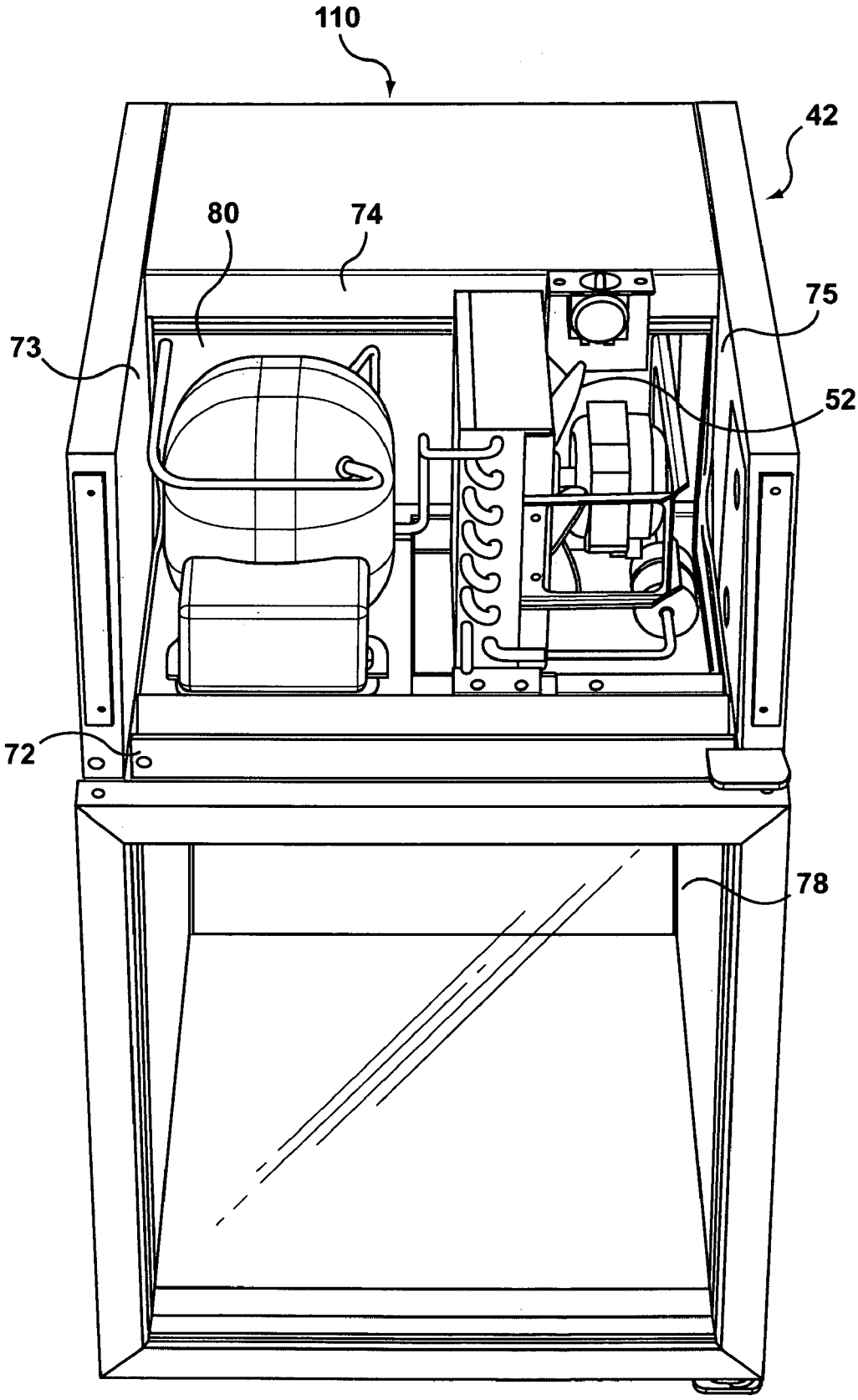
FIG. 22A is an isometric view of the preferred embodiment of the refrigerator, with a grille and a front panel removed, showing the condenser chamber with the modular refrigeration unit installed, drawn at a smaller scale.

In the preferred embodiment, as can be seen in FIG. 6A, the refrigeration cabinet 42 includes a condenser chamber 70 for receiving the condenser assembly 44. The condenser chamber 70 preferably includes insulated wall portions 72, 73, 74, 75 with mating surfaces 76 thereon (FIGS. 6A, 16B, 22A). The refrigeration cabinet 42 also includes an insulated main chamber 78, in which air is cooled by the evaporator assembly 46. The bulkhead assembly 48 is engageable with the mating surfaces 76 to form a substantially air-tight seal, so that the condenser chamber 70 is substantially insulated from the main chamber 78 when the modular refrigeration unit 40 is installed in the refrigeration cabinet 42 (FIG. 6B).

Because the conduit assembly 87 extends through the bulkhead assembly 48, the seal resulting from the engagement of the bulkhead assembly 48 with the mating surfaces 76 is not air-tight when the conduit assembly 67 is not blocked with moisture. In normal operating conditions, however, the conduit assembly 67 can be blocked with water, thereby assisting in providing an air-tight seal. The positive pressure in the main chamber 78 (created by the evaporator fan 62) generally reduces or minimizes air infiltration into the main chamber 78 via the conduit 67.

Figure 7:
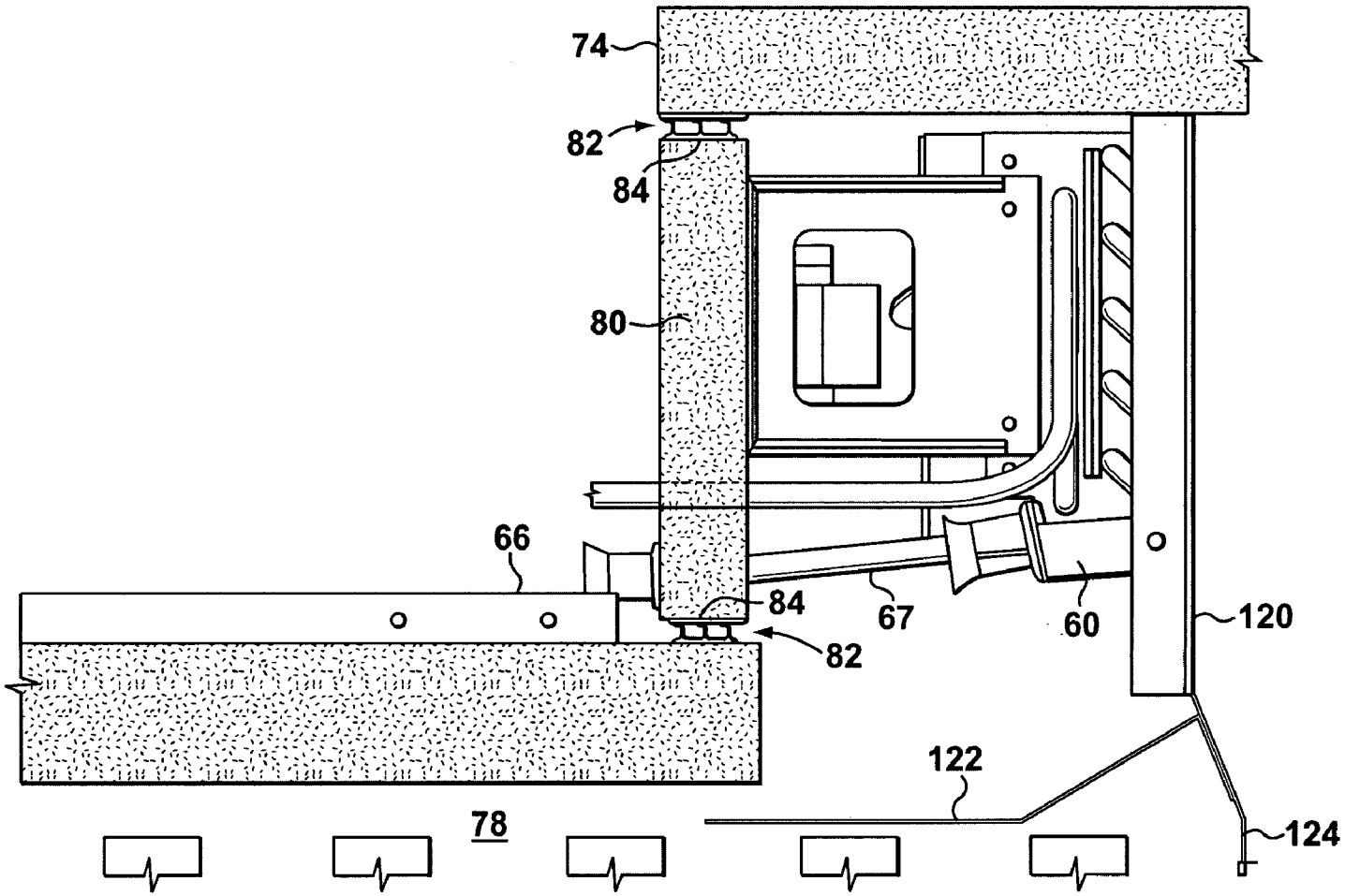
FIG. 7 is a cross-section of a portion of the refrigerator of FIG. 6B, showing a preferred embodiment of a gasket assembly of the modular refrigeration unit engaged with a mating surface in the refrigeration cabinet, drawn at a larger scale.
Figure 8A:
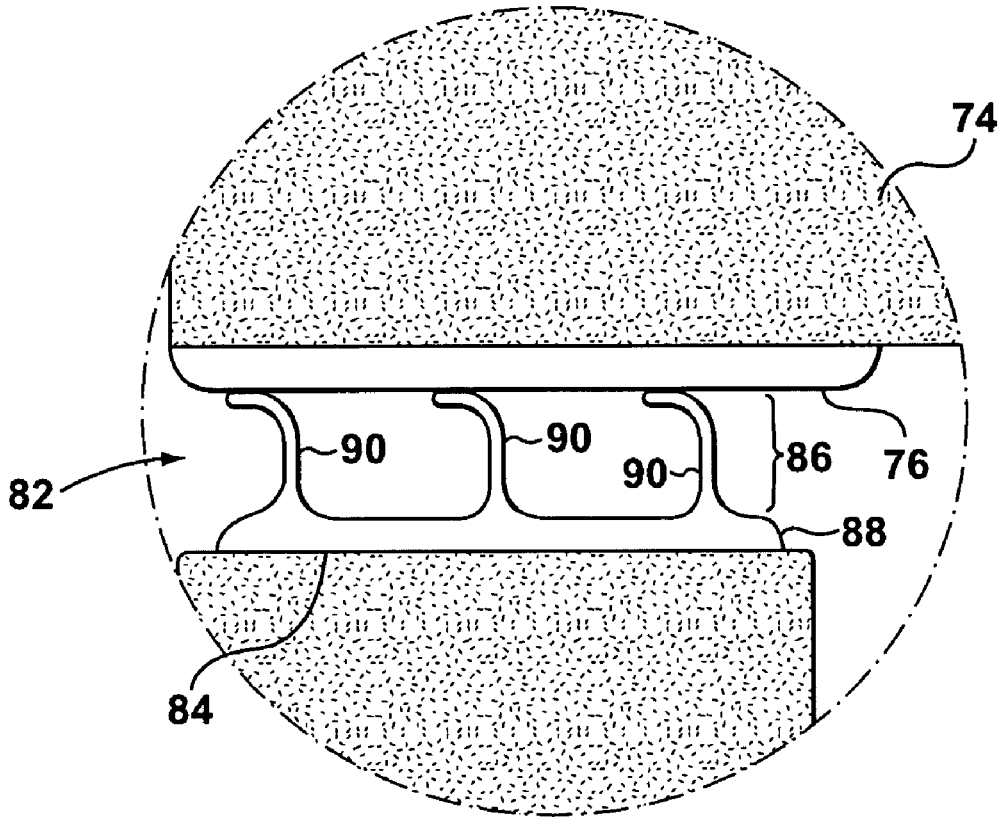
FIG. 8A is a cross-section of a portion of the gasket assembly engaged with the mating surface, drawn at a larger scale.
Figure 8B:
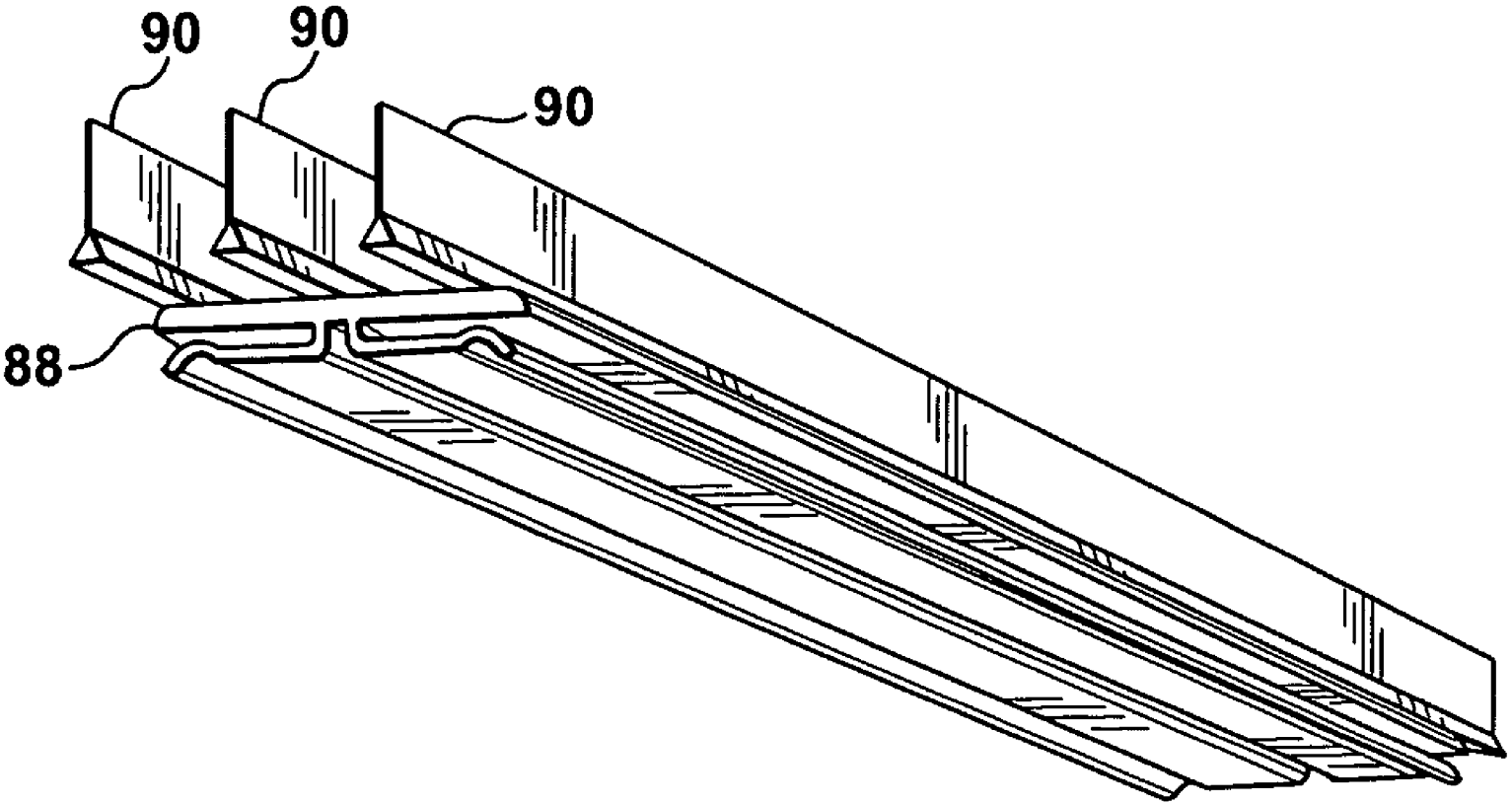
FIG. 8B is an isometric view of the gasket assembly of FIG. 8A.

Preferably, and as can be seen in FIGS. 7, 8A, and 8B, the bulkhead assembly 48 includes a bulkhead body portion 80 and a gasket assembly 82 positioned around a periphery 84 of the bulkhead body portion 80. The gasket assembly 82 is adapted for engaging with the mating surfaces 76 to seal the condenser chamber 70 from the main chamber 78. In the preferred embodiment, the gasket assembly 82 includes a gasket portion 86 and a thermal breaker portion 88, the thermal breaker portion 88 preferably being mounted on the periphery 84 of the bulkhead body portion 80.

As can be seen in FIGS. 8A and 8B, the gasket portion 86 preferably comprises a number of flexible vanes 90 protruding outwardly from the thermal breaker portion 88. The vanes 90 are adapted to engage with the mating surfaces 76 to form a substantially air-tight seal. Preferably, the vanes 90 are made of rubber having suitable characteristics, but any suitable material could be used, as would be appreciated by those skilled in the art. It is also preferred that the thermal breaker portion 88 is made of a hard plastic with low thermal conductivity, such as polyvinylchloride (PVC). However, any suitable material having low thermal conductivity may be used for the thermal breaker portion 88.

The mating surfaces 76 also comprise one or more thermal breakers. In order for suitable thermal insulation to be provided where the bulkhead assembly and the mating surfaces engage, thermal breakers should be provided both at the mating surfaces and in the bulkhead assembly.

In addition to the preferred embodiment shown, various other arrangements are possible. For example, the gasket assembly could be mounted on the interior wall surfaces in the cabinet 42, and mating surfaces (i.e., thermal breakers) could be provided in or on the bulkhead. Also, although the mating surface 76 is shown in FIG. 8A as protruding beyond the surface of the interior wall, the mating surface could also be positioned flush with the surface of the interior wall.

Although the gasket portion 86 is shown as comprising three vanes 90, many alternative structures would also be suitable. For example, the gasket portion 86 could comprise an air-filled, generally convex structure (not shown) made of rubber or any other suitably flexible material, arcing outwardly from the thermal breaker portion 88 when not engaged, positioned to engage with the mating surface.

It will also be evident to those skilled in the art that the mating surface 76, although shown in the drawings as forming a peripheral region which is oriented substantially vertically and horizontally and which is substantially coplanar, may be oriented in the refrigeration cabinet 42 in any manner, and need not be substantially coplanar. The positioning of the mating surfaces needs only to be consistent with that of the gasket portion 86, located at the periphery 84 of the bulkhead body portion 80 when the modular refrigeration unit 40 is installed in the cabinet 42, so that the substantially air-tight seal is formed. The bulkhead body portion 80 could have virtually any three-dimensional shape, and need not be only a three-dimensional rectilinear shape. For example, if desired, the bulkhead body portion 80 could have a three-dimensional curvilinear shape, or an irregular three-dimensional shape.

Figure 22B:
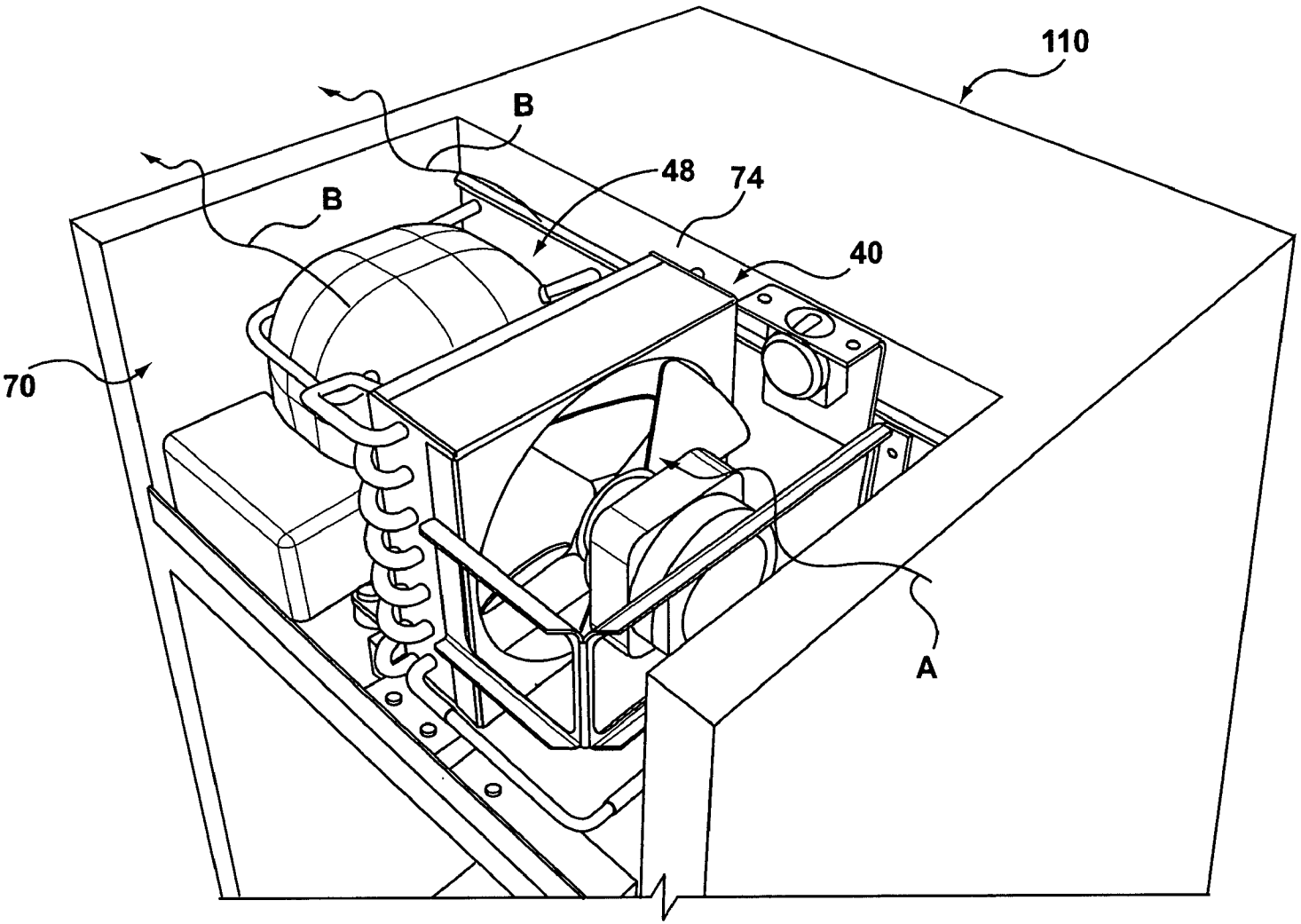
FIG. 22B is an isometric view of the refrigerator of FIG. 22A, showing a flow of air from the ambient atmosphere through the condenser chamber, drawn at a larger scale.
Figure 23:
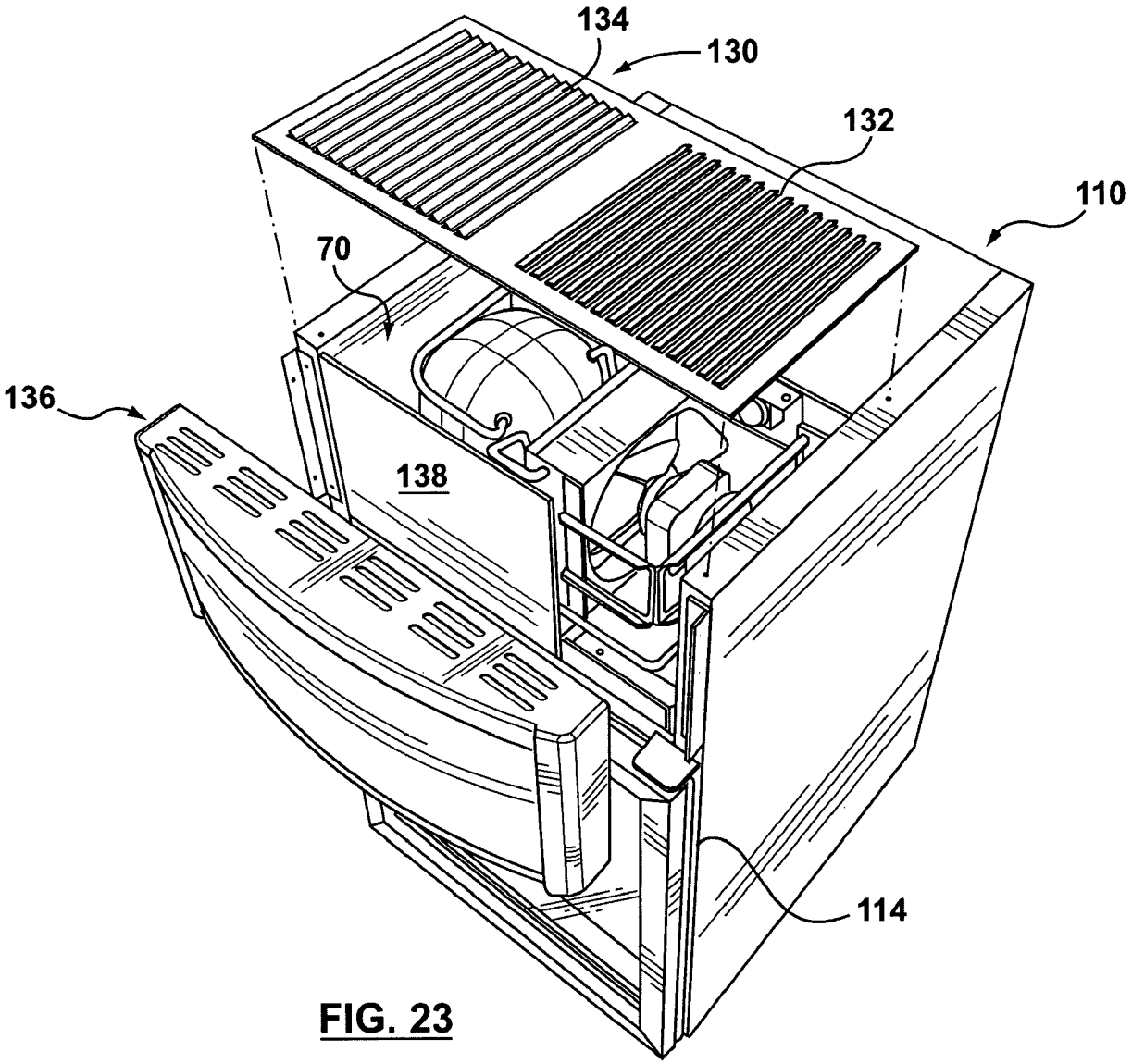
FIG. 23 is an exploded view of the preferred embodiment of the refrigerator, showing the positioning of the grille over the condenser chamber and a front panel adjacent to the condenser chamber, drawn at a smaller scale.

As can be seen in FIGS. 22A, 22B, and 23, the condenser fan 52 is positioned for creating a flow of air (designated by arrows "A" and "B" in FIG. 22B) into the condenser chamber 70 in a predetermined direction towards the condenser 50 and the compressor 56, to cool the condenser 50 and the compressor 56. Preferably, the predetermined direction of the airflow directed towards the condenser 50 and the compressor 56 is substantially parallel to the bulkhead portion 80, as shown in FIG. 22B.

It can be seen in FIGS. 1A, 1B, 1E, 2, and 5 that the condenser fan motor 54 and the condenser fan 52 are held in place by a condenser fan mounting bracket 92 with apertures 94 in the bracket 92, to permit the flow of air through the condenser 50. The evaporator 58 is supported by cantilever brackets 96 extending from the bulkhead body portion 80 to the evaporator 58. As shown in FIGS. 1B, 1C, 2, and 3, the brackets 96 include apertures 98 to permit air to flow from the evaporator fan 62 in the main chamber 78, as will be described.

A preferred embodiment of a refrigerator 110 includes a refrigeration cabinet 42 with insulated outer walls 112 and an access door 114, for accessing the main chamber 78 of the cabinet 42 (FIG. 6B ). (For the purposes hereof, "refrigerator" shall be understood to include freezers, refrigerators, and any other refrigerated devices.) Preferably, the condenser chamber 70 extends inwardly from an aperture 116 in the outer wall 112. The chamber 70 is at least partially defined by one or more insulated wall portions 72, 73, 74, 75 with mating surfaces 76 thereon. In the preferred embodiment, the mating surfaces 76 are positioned distal to the aperture 116. Preferably, the refrigerator 110 includes the preferred embodiment of the modular refrigeration unit 40, installed in the refrigeration cabinet 42 as shown in FIG. 6B.

Figure 18A:
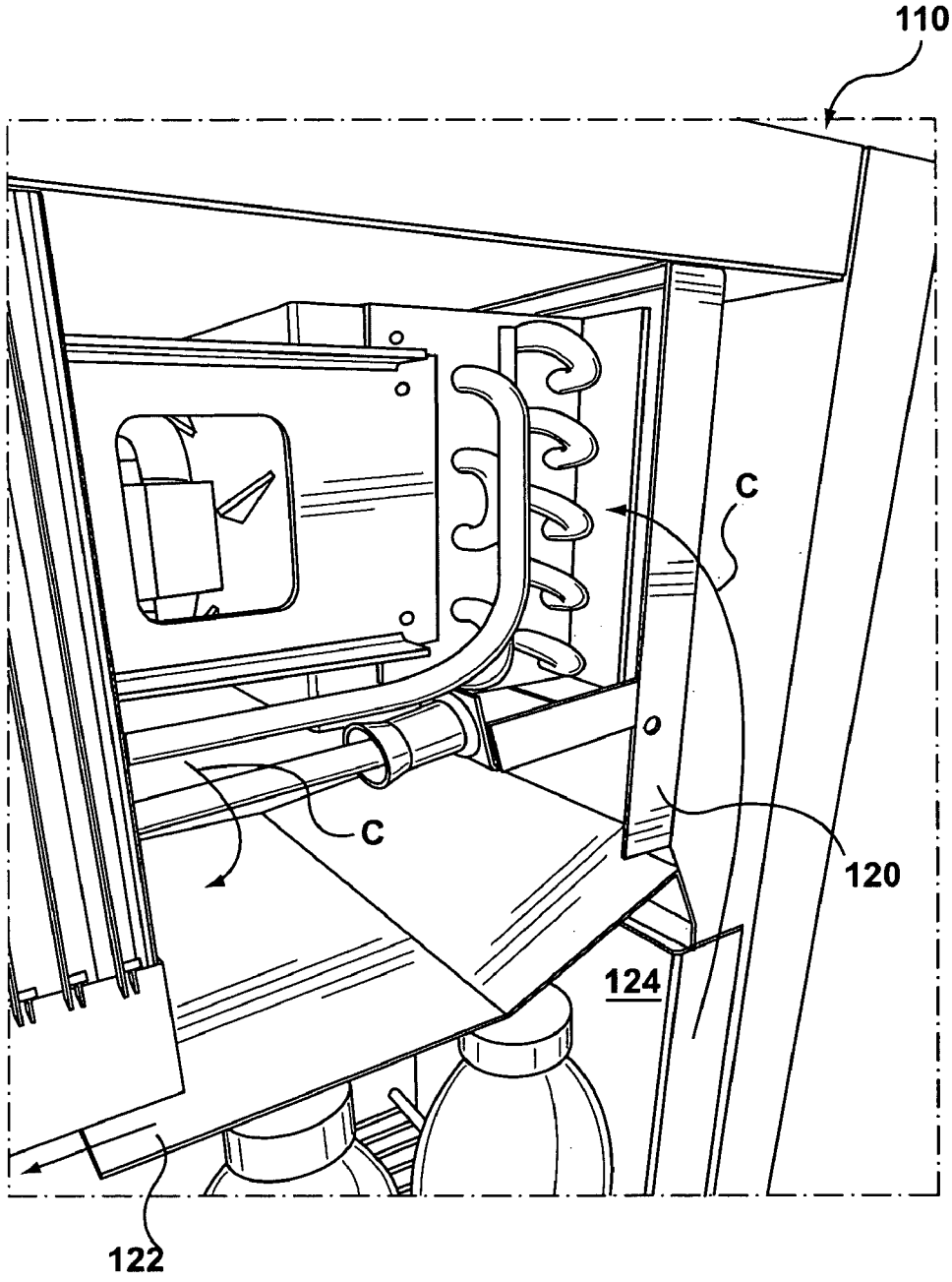
FIG. 18A is an isometric view of the modular refrigeration unit of FIG. 168 showing the flow of air through the evaporator, drawn at a larger scale.
Figure 18B:
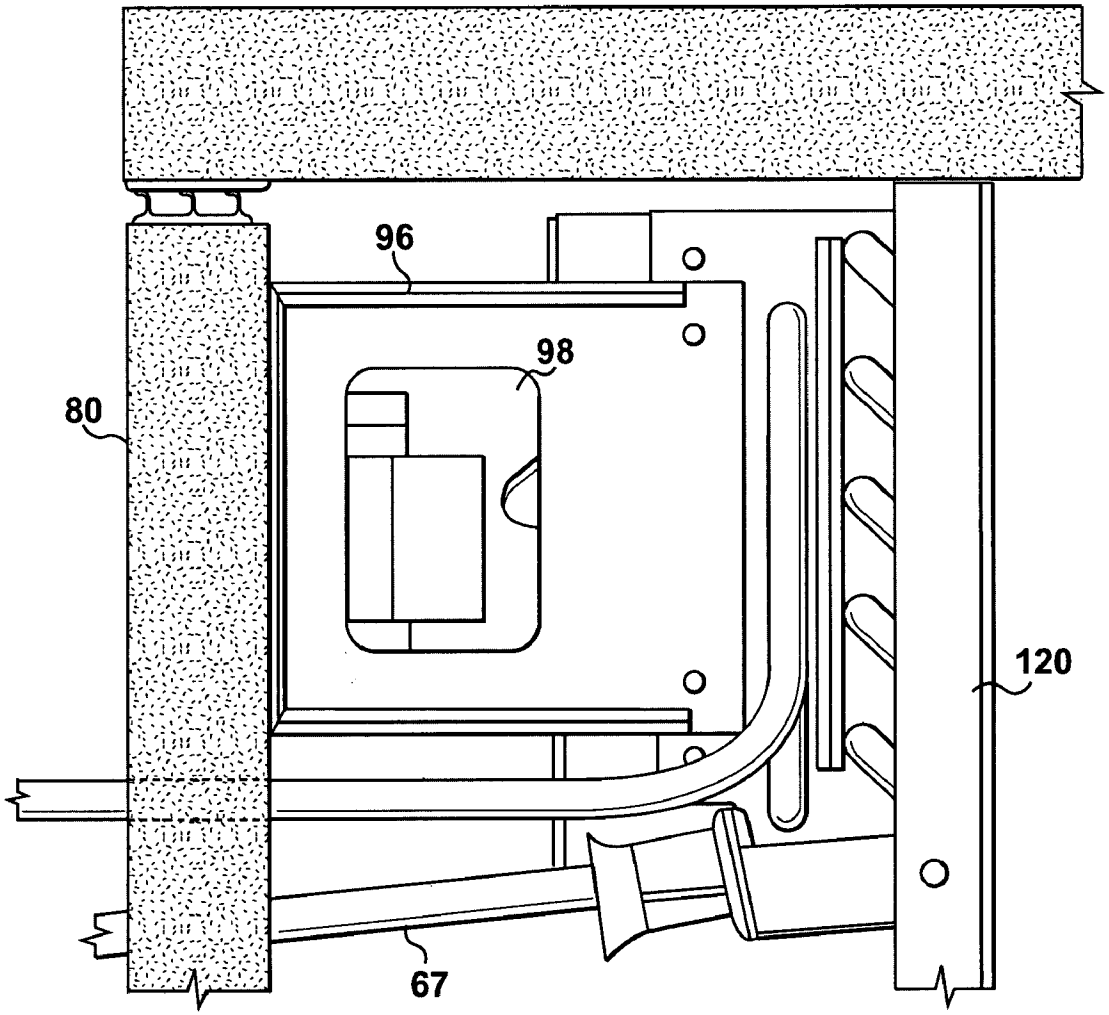
FIG. 18B is a side view of a mounting bracket supporting the evaporator in the modular refrigeration unit of FIG. 16B, drawn at a larger scale.

As can be seen in FIGS. 7 and 18A, the refrigerator 110 also preferably includes an evaporator shield assembly 120 positioned in the main chamber 78 for channelling a circulatory airflow in the main chamber 78 through the evaporator 58. The circulatory airflow in the main chamber 78 of the preferred embodiment of the refrigerator 110 is shown by arrows "C" in FIGS. 6B, 16B, 17, and 18A. In the preferred embodiment, the refrigerator 110 also includes a plenum 122 positioned adjacent to the evaporator 58, for guiding the circulatory airflow along a predetermined circulatory airflow path, indicated by the arrows "C". The preferred embodiment of the refrigerator 110 also includes a partition 124 which, as shown in FIG. 6B, is positioned substantially vertically in the main chamber 78 for directing a portion of the circulatory airflow toward the evaporator 58.

As can be seen in FIG. 6B, the plenum 122 and the partition 124 partially define an interior chamber portion 126 of the main chamber 78. Preferably, the plenum 122 includes numerous openings 128 (FIG. 6B) formed to direct a predetermined volume of air following the circulatory airflow path into the interior chamber portion 126.

It will be appreciated that the contents of the interior chamber portion 126 could be any objects desired to be refrigerated. Solely by way of example, the contents are shown as bottled goods.

The walls of the refrigeration cabinet 42 are preferably insulated using polyurethane foam, as is known in the art. Preferably, the bulkhead body portion 80 is insulated using suitably sized blocks, or panels, of insulative material, to simplify manufacturing. However, the bulkhead body portion 80 could be insulated using polyurethane foam. In addition. In an alternative embodiment (not shown), the breaker portion 88 of the gasket assembly 82 could, if desired, be integrally formed as part of the bulkhead body portion 80. This could be done, for example, by including the breaker portion in a "skin" used as a mould for the polyurethane foam. If this approach were taken, however, then the gasket portion 84 would preferably be replaceable, i.e., in the event that parts of the gasket portion 84 were broken off or damaged during use.

In the preferred embodiment, the modular refrigeration unit 40 includes a base 43 to which the condenser 50, the compressor 56, and the bulkhead body portion 80 are preferably secured. As can be seen in FIGS. 1D, 1E, 2, 3, and 5, the base 43 generally supports the condenser assembly 44 and the bulkhead assembly 48.

In use, as shown in FIG. 6A, the modular refrigeration unit 40 is placed on the wall 72 and pushed into the cabinet 42 until the gasket assembly 82 has fully engaged with the mating surface 76. It will be noted that, because of the positioning of the gasket assembly 82 around the periphery 84 of the bulkhead body portion 80, continued pressure in the direction of arrow "X" in FIG. 6A is not required in order to maintain an air-tight seal at the bulkhead assembly 48.

Although the modular refrigeration unit 40, as shown in the drawings, includes the preferred embodiment of the condenser 50, the condenser fan 52, and the condenser fan motor 54 positioned on the right side of the unit 40 when viewed from the front (see, e.g., FIGS. 1A and 5), with the compressor 56 positioned on the left, it will be appreciated by those skilled in the at that the unit 40 could also be constructed with the compressor 56 located on the right side and the compressor 50, the compressor fan 52 and the compressor fan motor 54 positioned on the left side. The positioning of the conduit 67 would also have to be changed accordingly in such alternate configuration. As will also be appreciated by those skilled in the art, the flow of air through the condenser chamber 70 would generally be from left to right (as viewed from the front) if a modular refrigeration unit 40 having such alternate configuration were used.

Figure 11:
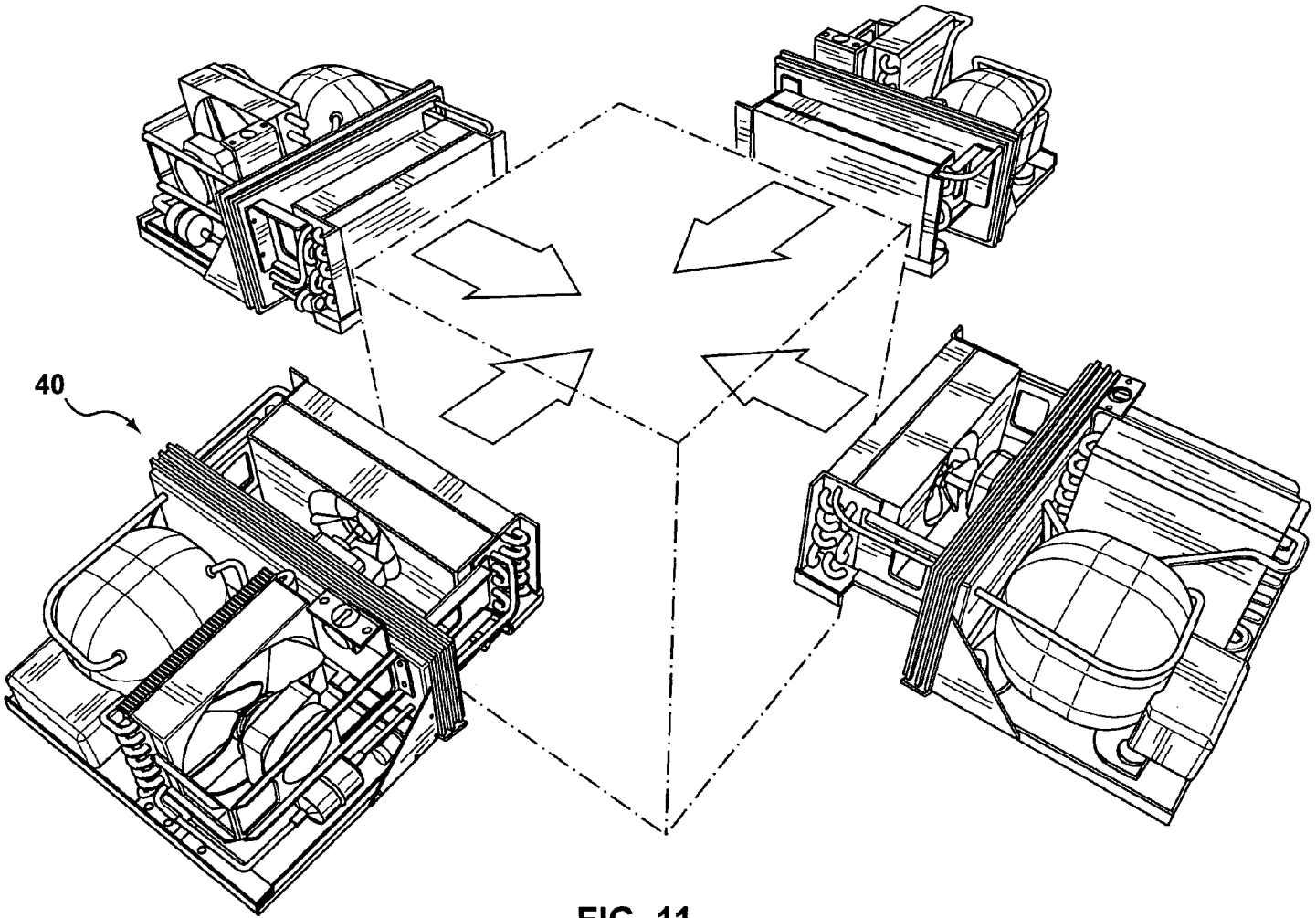
FIG. 11 is a schematic view of various embodiments of the refrigerator showing various ways of loading a top-mounted modular refrigeration unit, drawn at a smaller scale.
Figure 15:
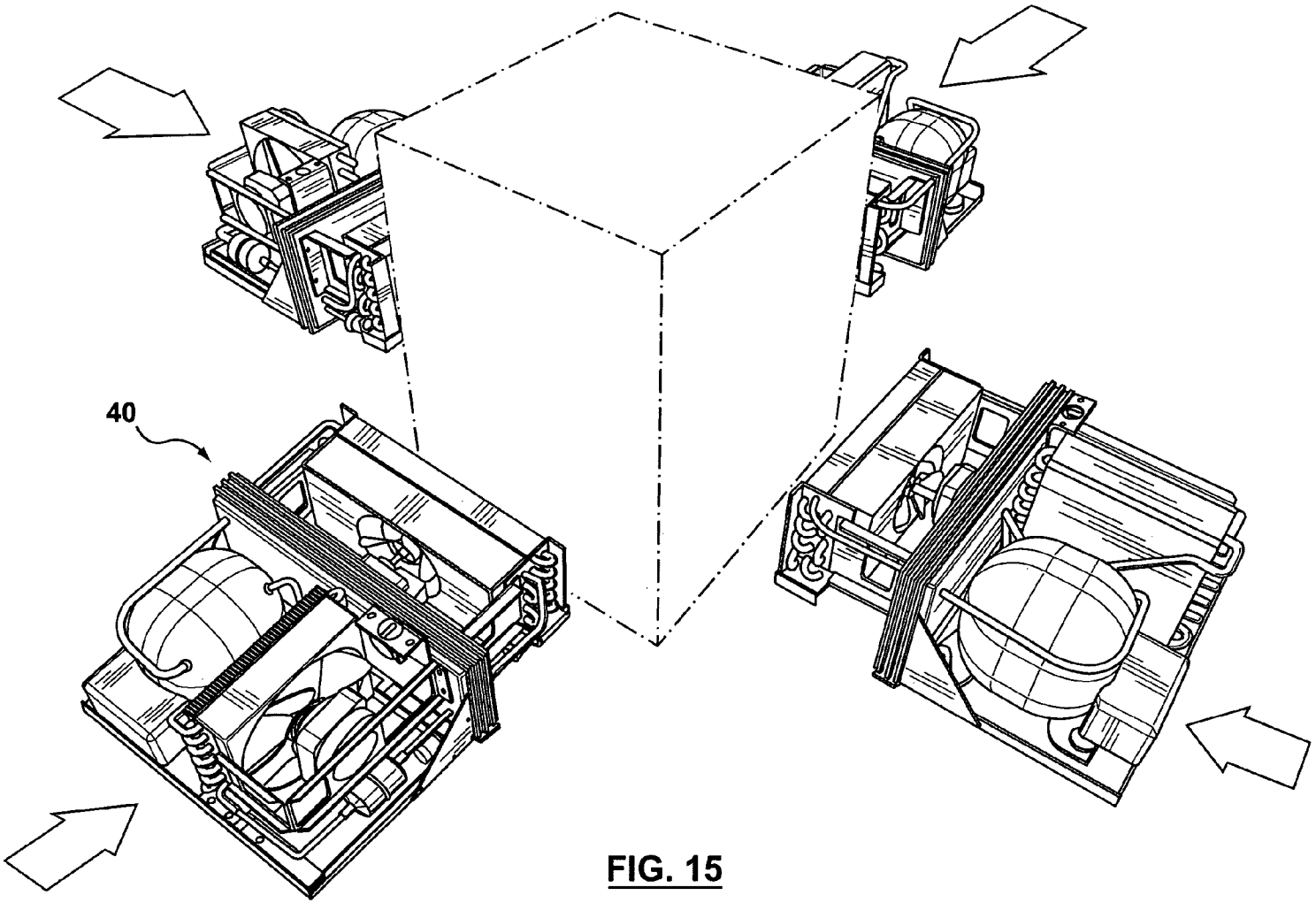
FIG. 15 is a schematic view of various embodiments of the refrigerator showing various ways of loading a bottom-mounted modular refrigeration unit, drawn at a smaller scale.

As can be seen in FIG. 11, the preferred embodiment of the modular refrigeration unit 40, if top-mounted in the refrigeration cabinet, can be loaded from any of the four sides of the cabinet. As will be described, the cabinet can be adapted to receive the modular refrigeration unit 40, depending on the side from which the modular refrigeration unit 40 is loaded. Alternatively, the modular refrigeration unit 40 can be bottom-mounted, as schematically shown in FIG. 15, and the refrigeration cabinet can be adapted to receive the modular refrigeration unit 40, loaded from any of the four sides of the cabinet.

Figure 9:
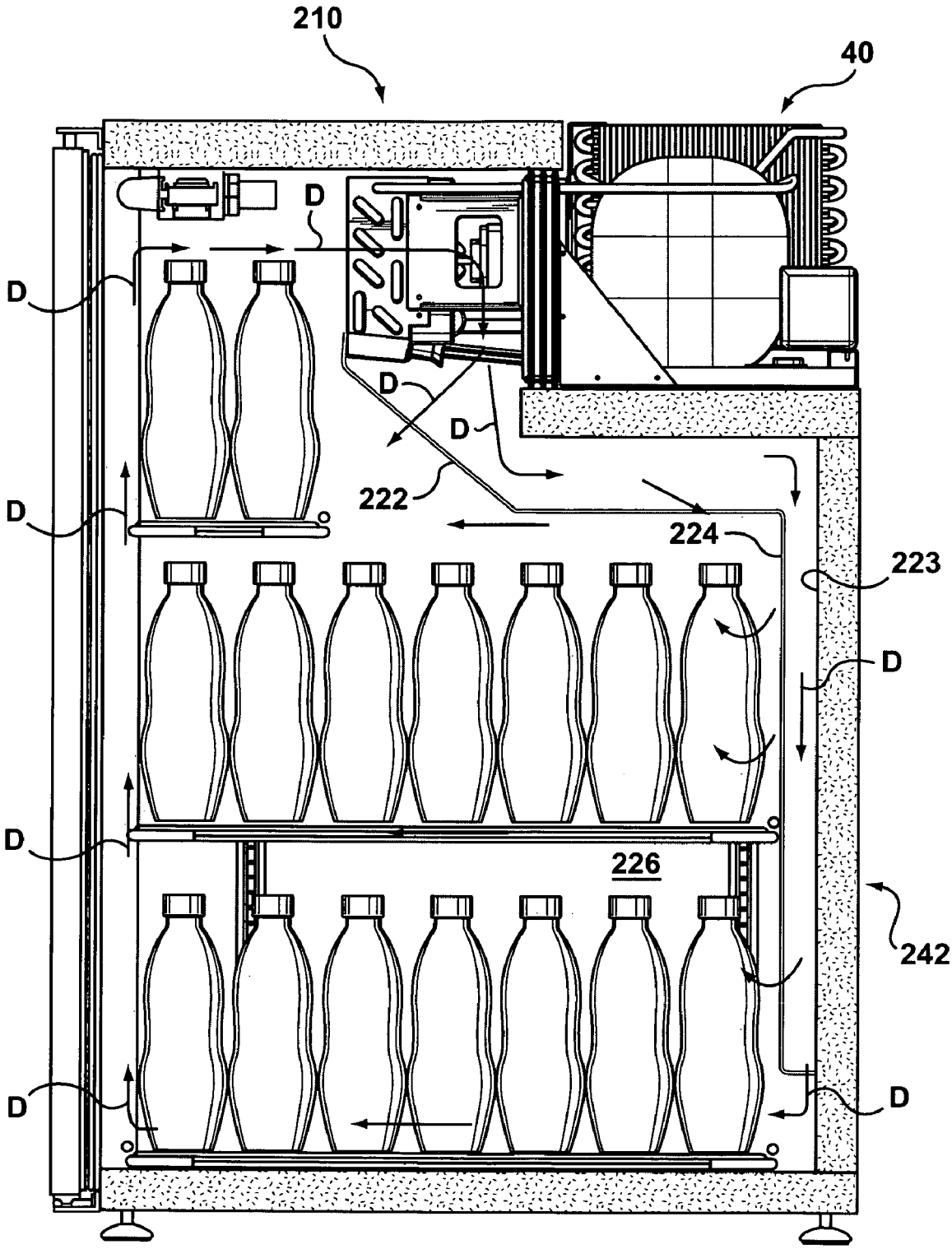
FIG. 9 is a cross-section of an alternative embodiment of the refrigerator including a preferred embodiment of a partition, drawn at a smaller scale.
Figure 10:
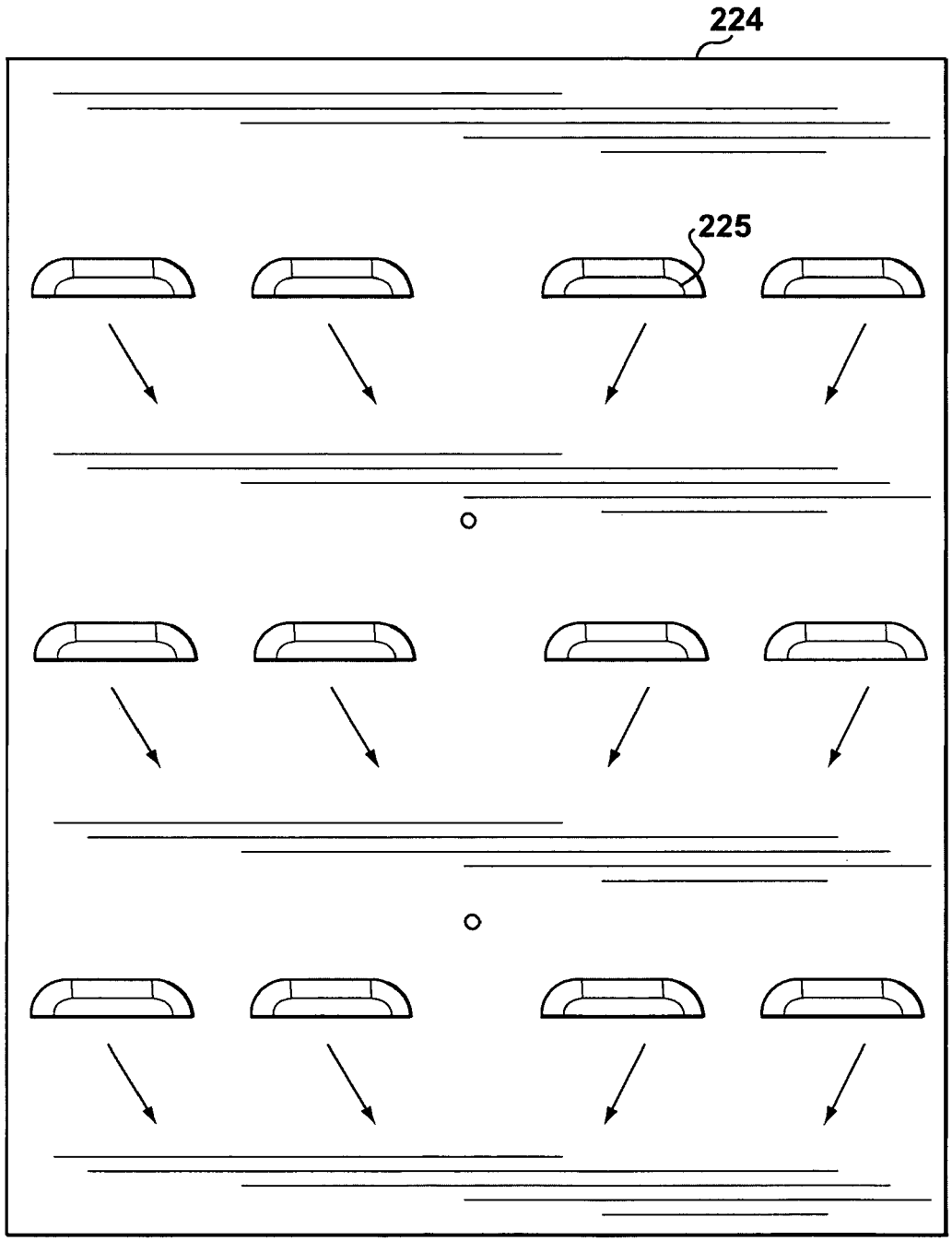
FIG. 10 is a front elevation view of the partition of FIG. 9, drawn at a larger scale.

An alternative refrigerator 210, showing a top-mounted unit 40 loaded from the rear side of a cabinet 242, is shown in FIG. 9. A circulatory air flow path is shown by arrows "D". In the cabinet 242, cooled air exiting the evaporator 58 is directed by a plenum 222 towards a back wall 223, where the air is guided by a partition 224. The partition 224 includes openings 225 to direct a portion of the air into an interior chamber 226 (FIG. 10).

It will be observed that the interior chamber 226 has slightly greater capacity than the interior chamber 126 in the refrigerator 110. However, different industry requirements may dictate the use of one refrigerator configuration over the other in a particular application.

Where the modular refrigeration unit 40 is top-mounted and side-loaded, the layouts of the cabinets 42 or 242 could be used, depending on the ultimate users requirements. However, it should be noted that the same modular refrigeration unit 40 can be used in all configurations. The same modular refrigeration unit 40 can be used in a variety of refrigerators, having various sizes and configurations. The versatility of the modular refrigeration unit 40, it will be appreciated, results in a number of advantages. First, due to this standardization, the unit costs of the components in a refrigerator which tend to be the most expensive tend to be lowered, due to relatively larger production volumes of the components. Second, a commonality among other components of refrigerators of different sizes and configurations is possible to a greater degree. Third, the interchangeability of the modular refrigeration unit 40 in various refrigerators results in cost advantages in servicing.

Figure 12:
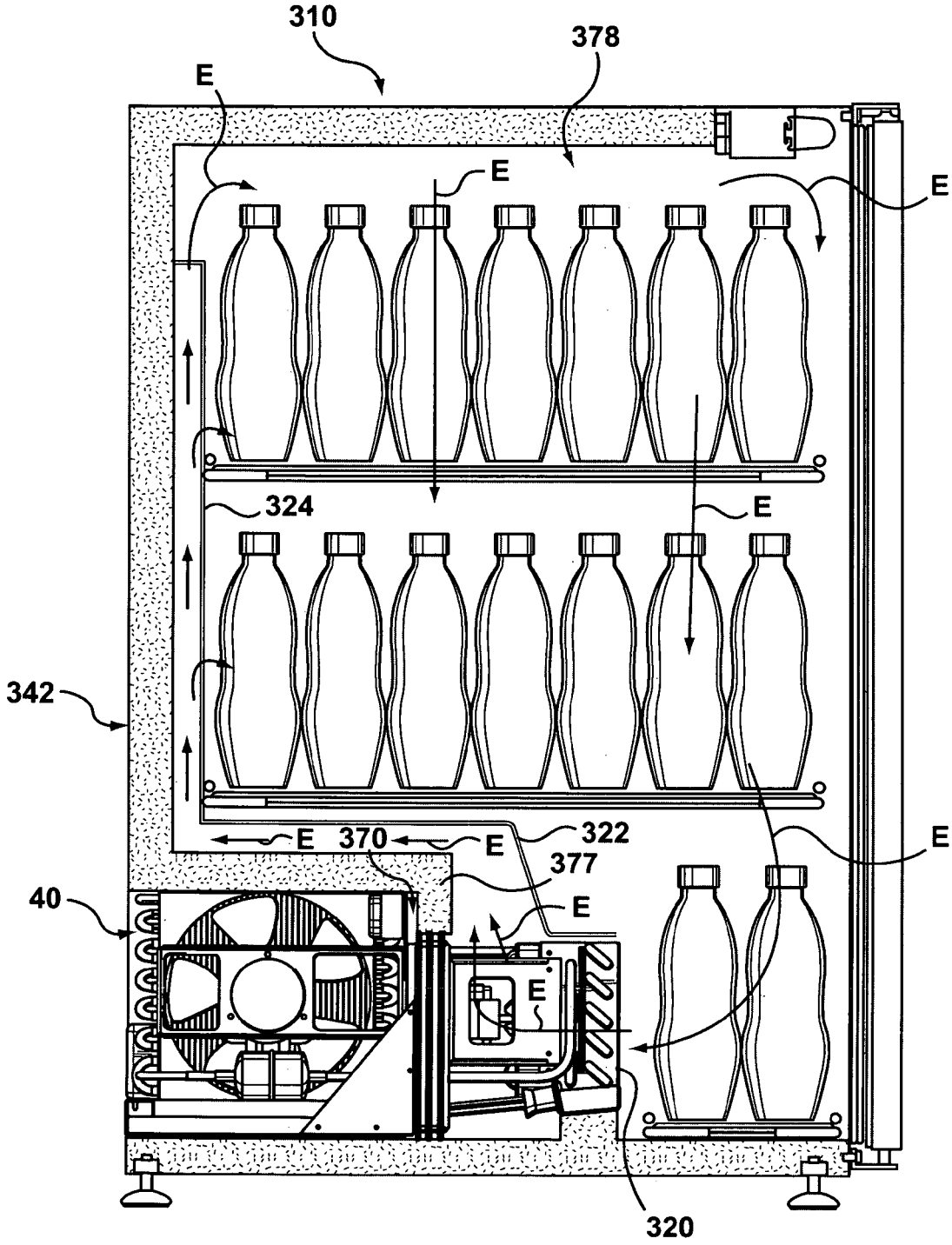
FIG. 12 is a cross-section of an alternative embodiment of the refrigerator including an alternative embodiment of a partition, drawn at a larger scale.
Figure 13:
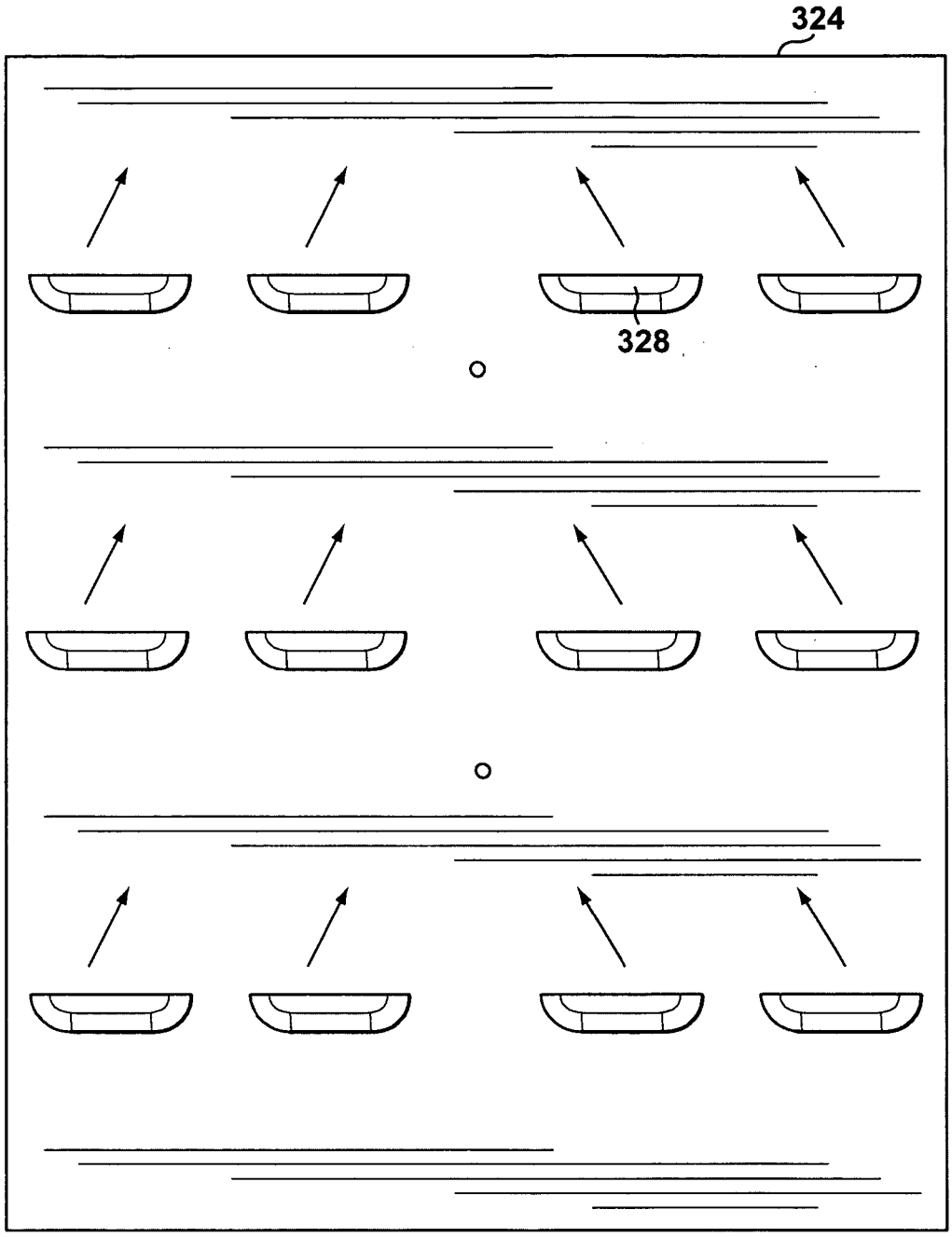
FIG. 13 is a front elevation view of the partition of FIG. 12, drawn at a larger scale.

A bottom-mounted, rear-loaded modular refrigeration unit 40 is shown installed in a cabinet 342 in FIG. 12, in a refrigerator 310. The cabinet 342 includes an evaporator shield 320, a plenum 322, and a partition 324. A circulatory air flow path in a main chamber 378 is shown by arrows "E". The partition 324 includes openings 328, as shown in FIG. 13. A condenser chamber 370 is defined by an interior wall 377 forming a ceiling above the chamber 370.

Figure 14:
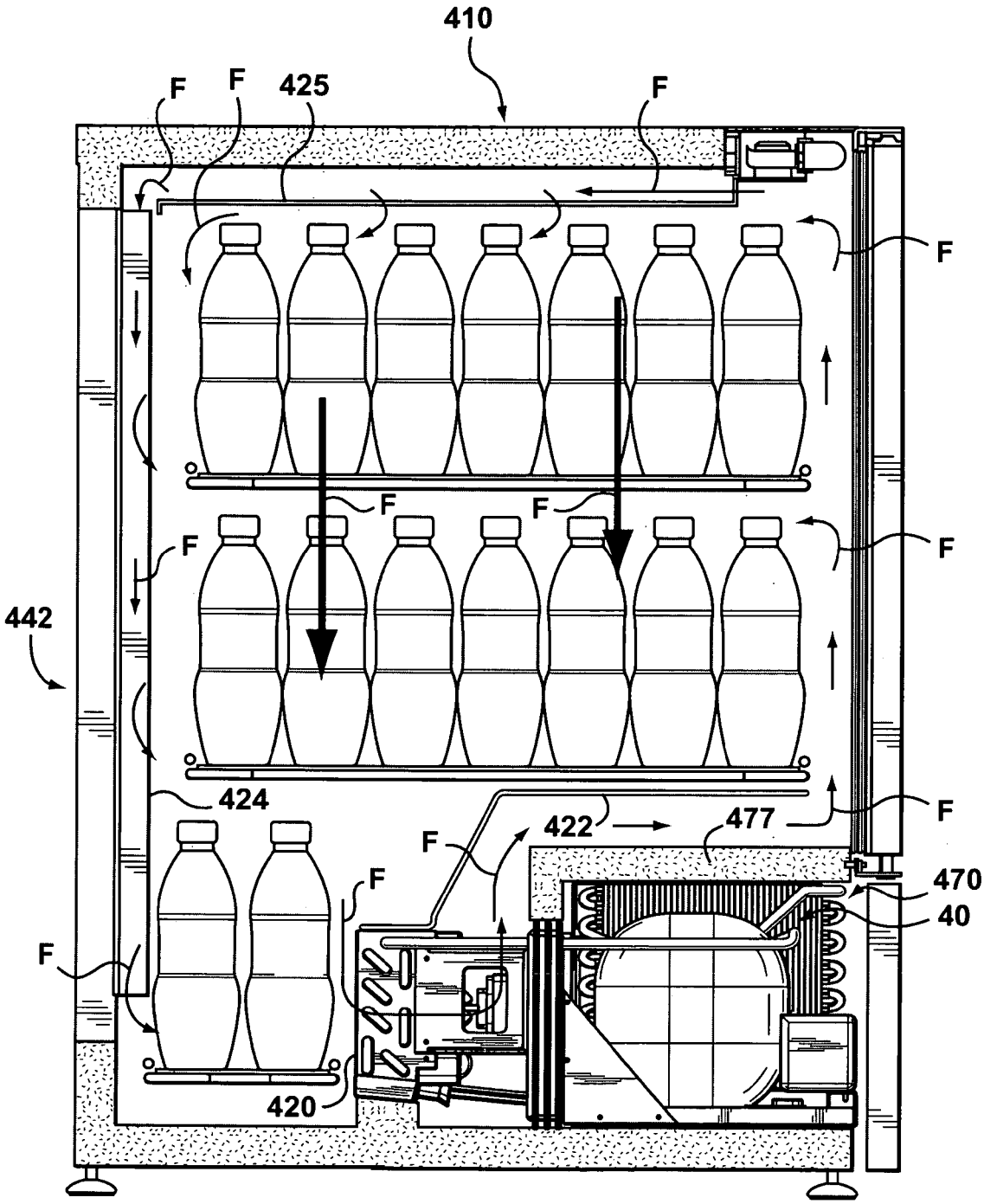
FIG. 14 is a cross-section of another alternative embodiment of the refrigerator.

In another alternative embodiment 410 of the refrigerator, the modular refrigeration unit 40 can be bottom-mounted and front-loaded, as shown in FIG. 14. A cabinet 442 includes an evaporator shield assembly 420, a plenum 422, and a partition 424. Preferably, another partition 425 is also included in the cabinet 442. A circulatory air flow path in a main chamber 478 is shown by arrows "F". The cabinet 442 also include an interior wall portion 477 forming a ceiling of a condenser chamber 470.

Figure 19:
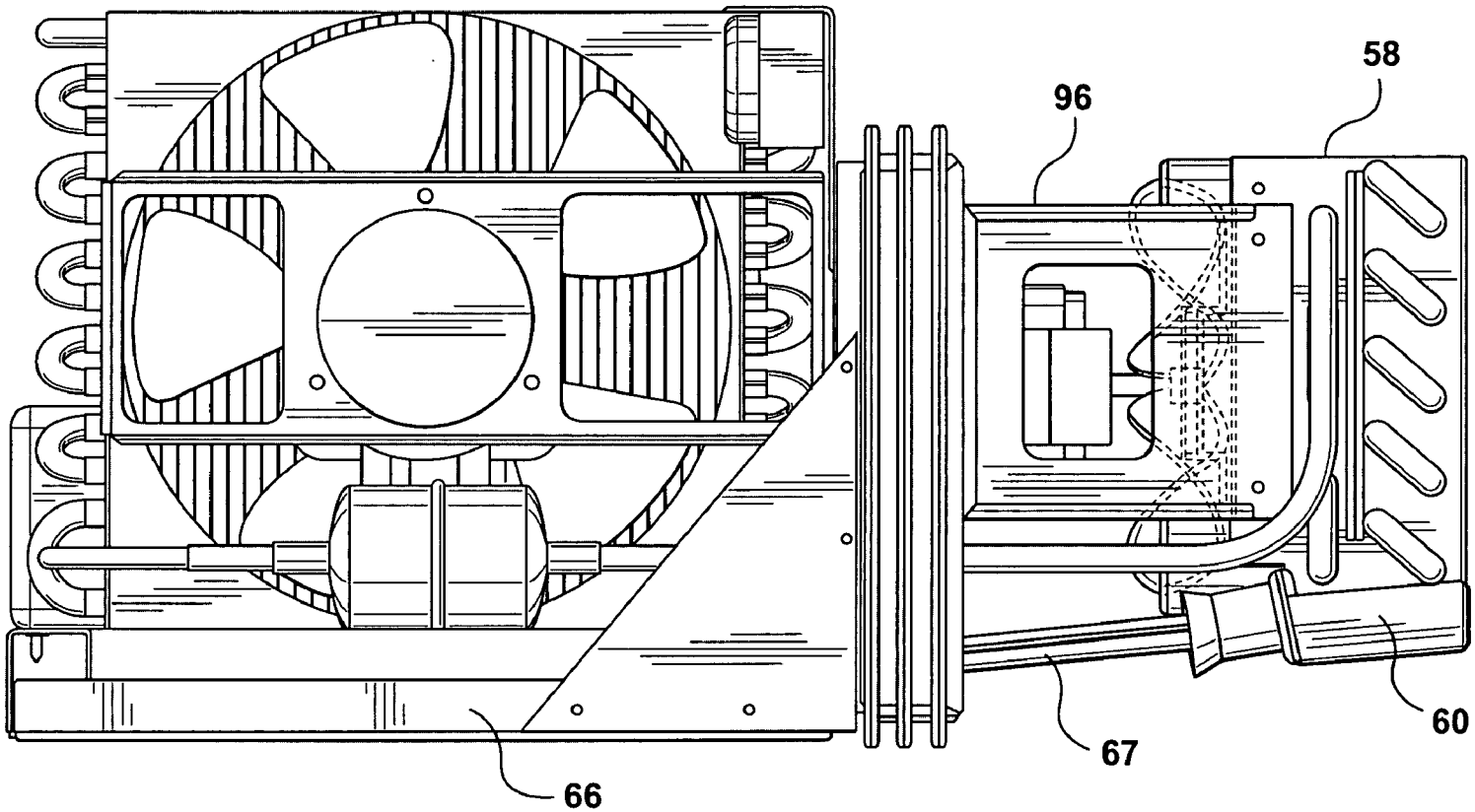
FIG. 19 is a side view of the right side of the modular refrigeration unit of FIG. 16B, showing an evaporator pan and a condenser pan, drawn at a smaller scale.
Figure 20:
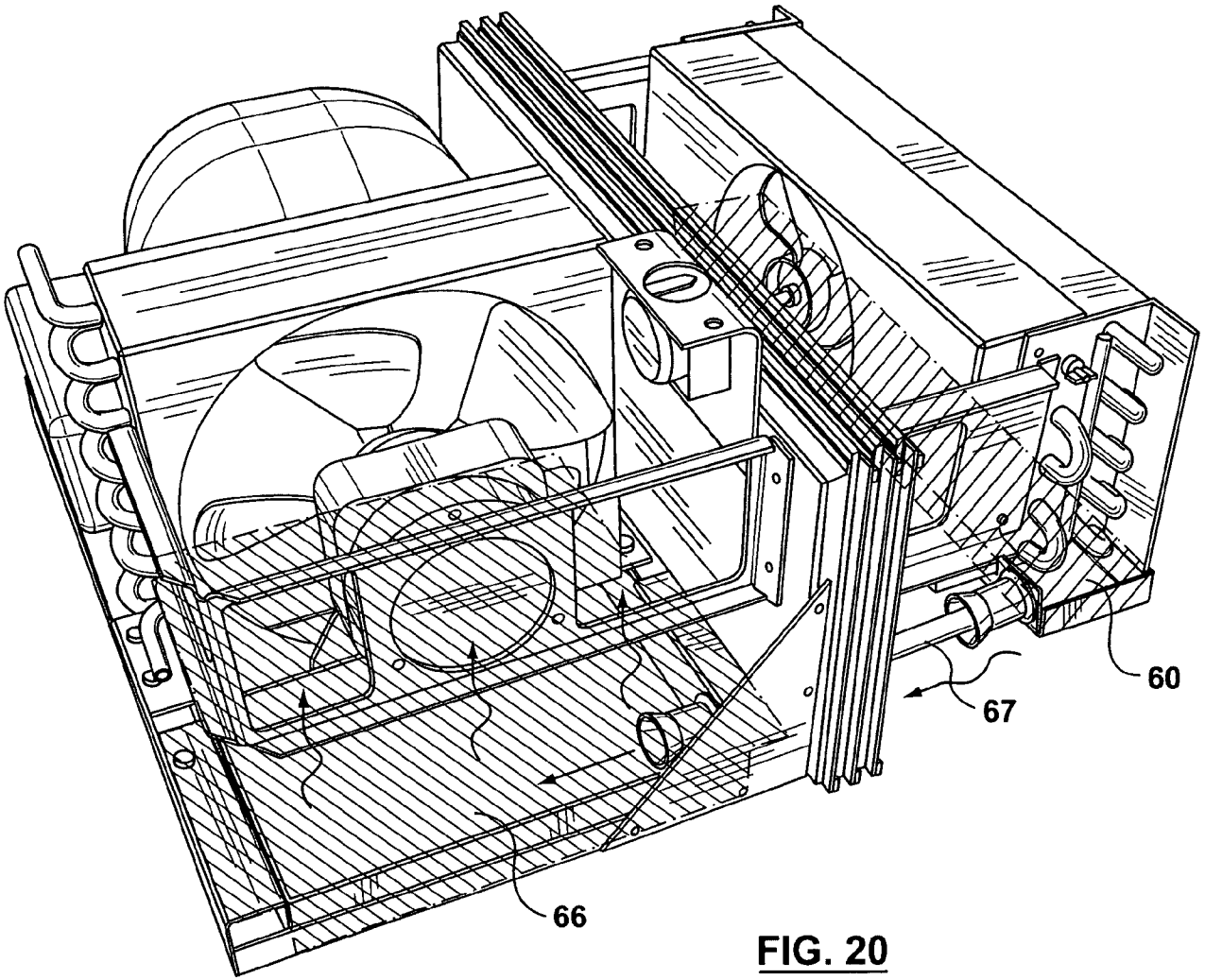
FIG. 20 is an isometric view of the preferred embodiment of the modular refrigeration unit showing the evaporator pan and a preferred embodiment of the condenser pan.
Figure 21:
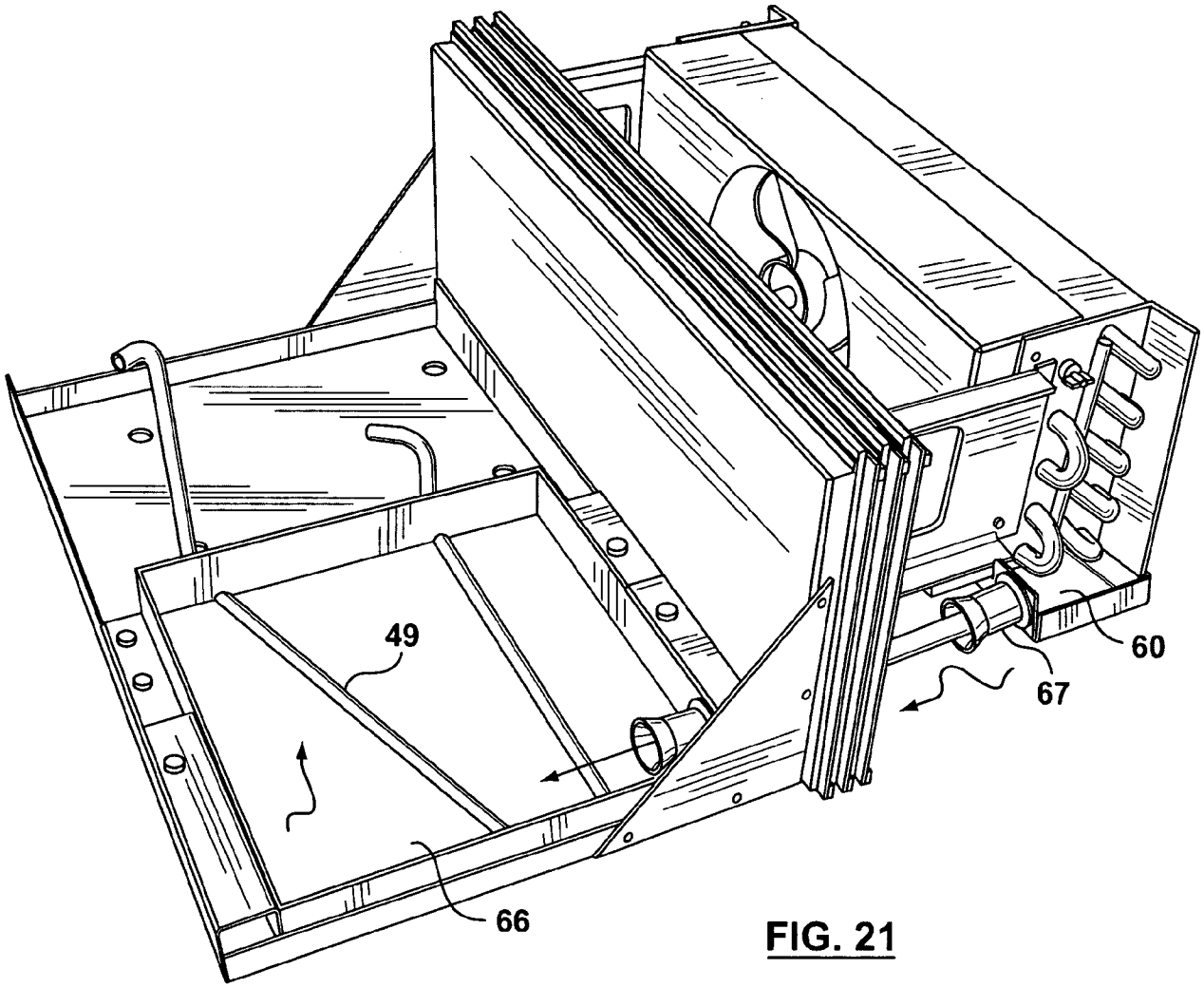
FIG. 21 is an isometric view of the modular refrigeration unit showing an alternative embodiment of the condenser pan.
Figure 24:
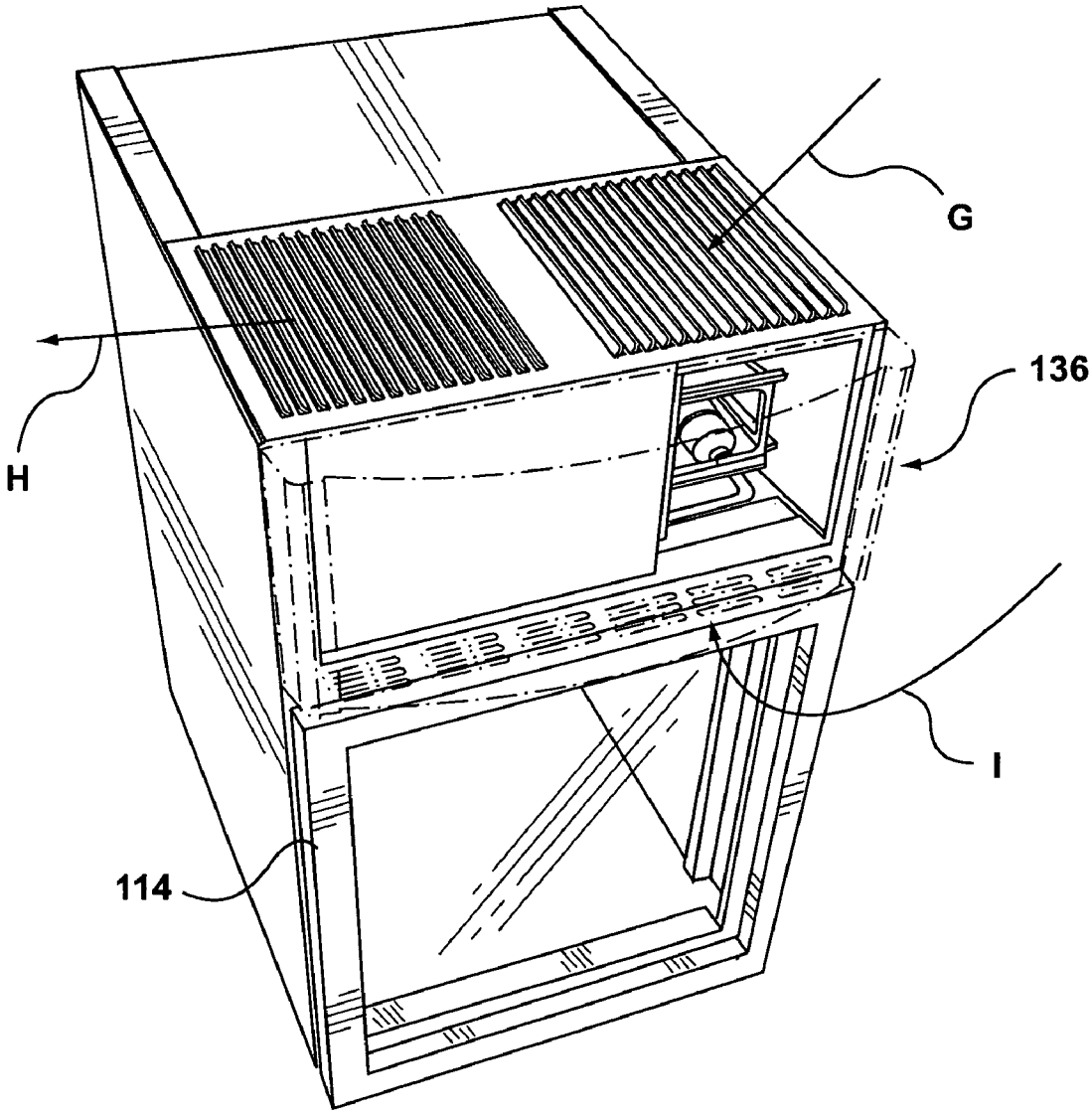
FIG. 24 is an isometric view of the refrigerator of FIG. 23, showing the grille and the front panel installed on the refrigeration cabinet and schematically representing the flow of air into the condenser chamber and exiting the condenser chamber.
Figure 25:
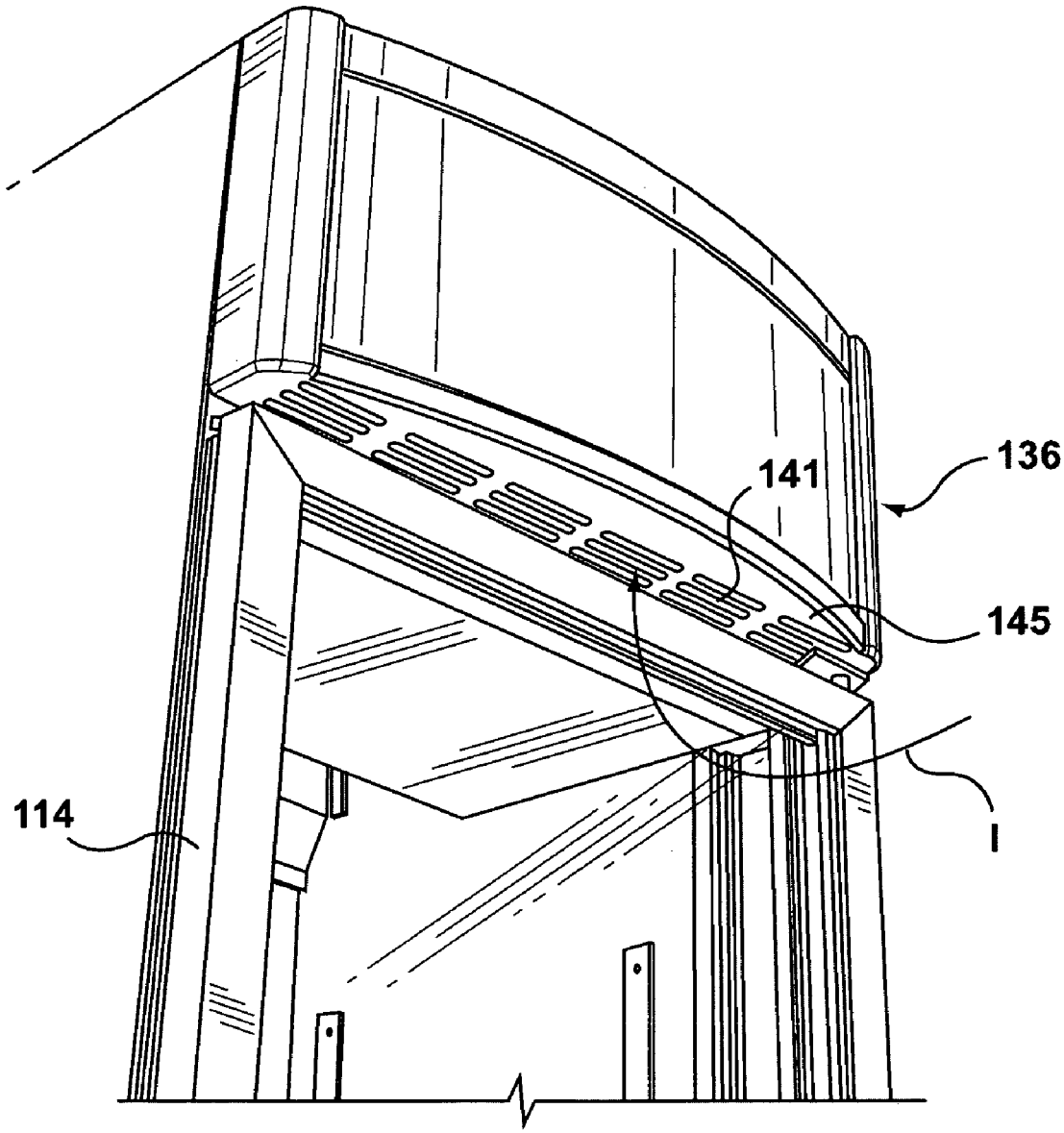
FIG. 25 is an isometric view showing an underside of the front panel of FIG. 24, showing openings therein to permit air passage therethrough.

As shown in FIGS. 19 and 20, condensed moisture which drips into the evaporator tray 60 is drained through the conduit assembly 67 to the condenser tray 66, from which the liquid (water) is evaporated. Air flow through the condenser chamber and heat from the condenser 60 expedite evaporation. An alternative embodiment of the condenser tray is shown in FIG. 21, in which a loop of tubing 49 from the condenser 50 is positioned in the bottom of the condenser tray 66, to provide additional heat, for faster evaporation of the water collecting in the condenser tray 66, As can be seen in FIGS. 23-25, a grille 130 is preferably attached to the exterior of the cabinet 42 above the condenser chamber 70. The grille 130 includes a set of intake louvers 132 or openings and a set of exhaust louvers 134. The intake louvers 132 are configured to permit air flow into the condenser chamber 70, to present a minimum of obstruction to the air flow. Similarly, the exhaust louvers 134 are configured so as to present a minimum of obstruction to the air flow out of the condenser chamber 70. Air flow intake and exhaust through the grille 130 are schematically represented by arrows "G" and "H" respectively in FIG. 24.

As can be seen in FIGS. 23-25, the preferred embodiment of the cabinet 42 preferably includes a top front panel assembly 136 which is positioned adjacent to the condenser chamber 70 and above the access door 114. As shown in FIG. 23, a shield 138 is preferably positioned between the panel 136 and the compressor 56 in order that the flow of air through the compressor chamber 70 may be guided to exhaust through the exhaust louvers 134. The shield 138 is intended to prevent immediate recirculation of air after it has passed through the condenser 50.

The front panel assembly 136 preferably includes intake louvers 141 positioned along a bottom surface 145 of the panel assembly 136. As can be seen in FIGS. 24 and 25, the intake louvers 141 are positioned to permit air to be drawn through them as indicated by arrow "I", and into the side of the condenser chamber 70, to exhaust through the exhaust louvers 134, as shown by arrow "H".

Figure 26:
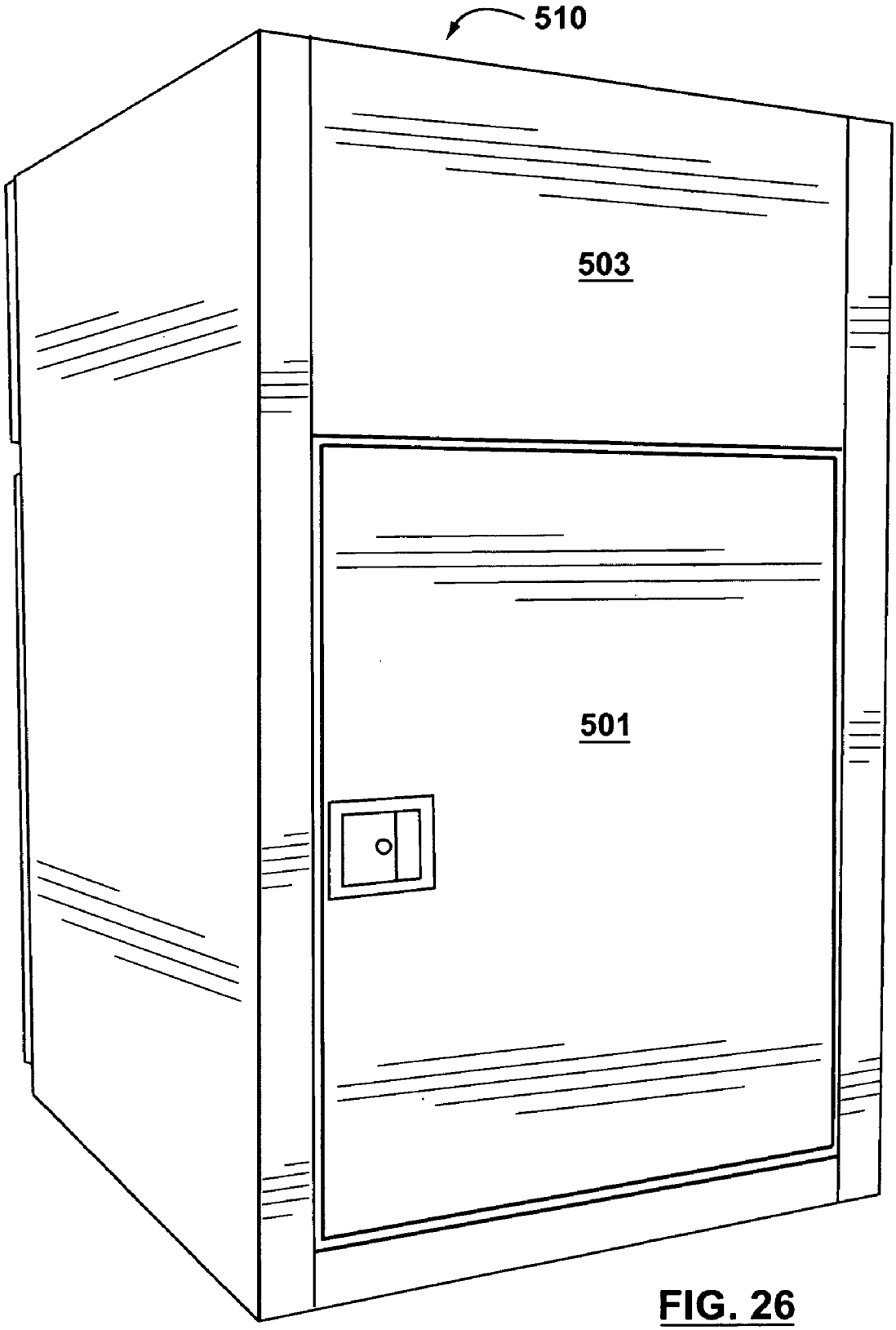
FIG. 26 is an isometric view of a preferred embodiment of the refrigerator showing a secondary access door in a closed position, drawn at a smaller scale.
Figure 27:
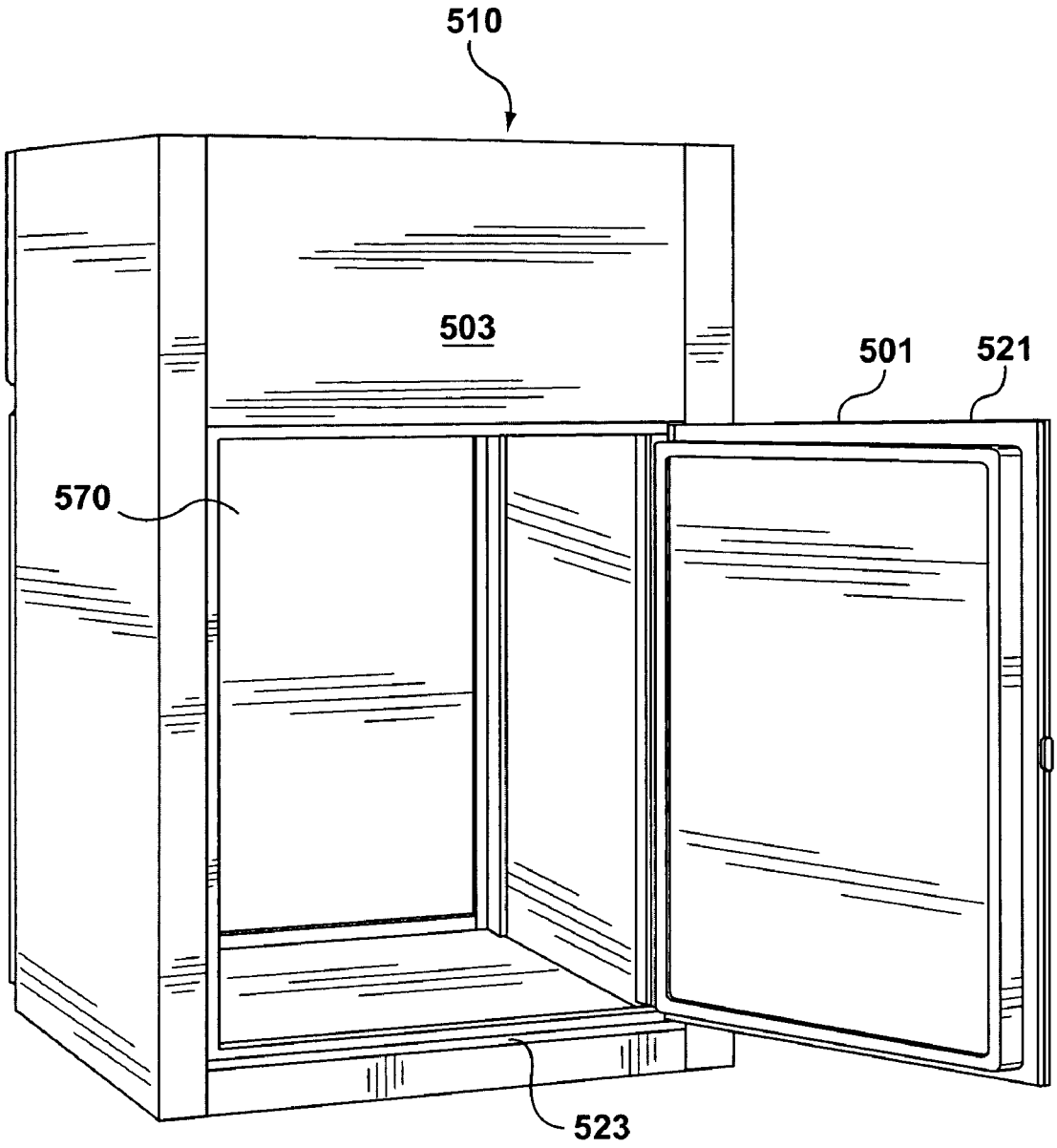
FIG. 27 is an isometric view of the refrigerator of FIG. 26 showing the secondary access door in an open position.
Figure 28:
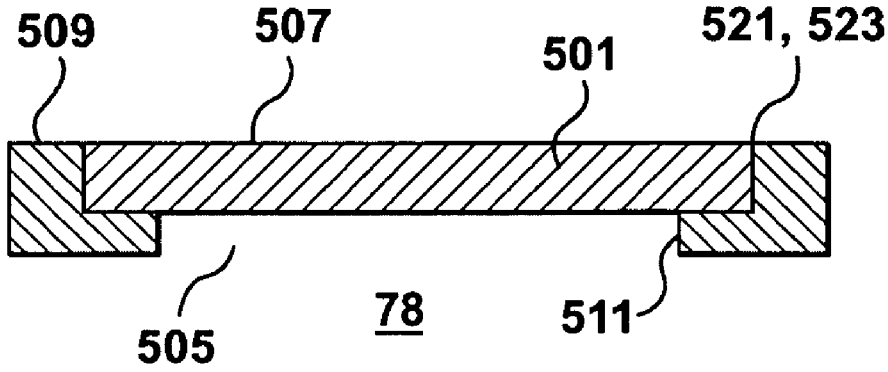
FIG. 28 is a cross-section of a the secondary access door of FIG. 27 showing portions of a preferred embodiment of an outer wall of the refrigeration cabinet, drawn at a larger scale.
Figure 29:
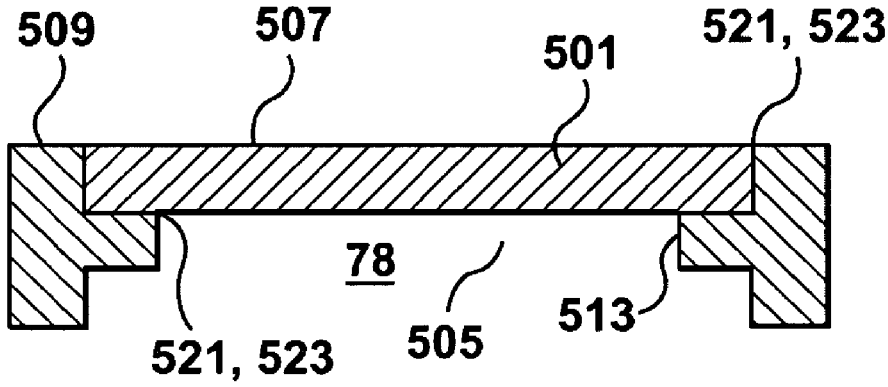
FIG. 29 is a cross-section of the secondary access door showing portions of an alternative embodiment of the outer wall.

An alternative embodiment 510 of the refrigerator is shown in FIGS. 26 and 27. The refrigerator 510 includes a secondary access door 501 which is positioned in an outer wall 503, for accessing the main chamber 78. As shown in FIGS. 26 and 27, the secondary access door 501 is moveable between a closed position (FIG. 26) and an open position (FIG. 27). The outer wall 503 includes an opening 505 for receiving the secondary access door 501 so that, when the secondary access door 501 is in the closed position, an exterior surface 507 of the secondary access door 501 is substantially flush with an external surface 509 of the outer wall 503 (FIGS. 28, 29).

Thermal breakers 521, 523 are positioned on the door 501 and around the opening 505 respectively to provide insulation around the opening 505 when the door 501 is closed.

It will be appreciated by those skilled in the art that the secondary access door 501 preferably is insulated at least to the same extent as the outer wall 503, to minimize heat loss from the main chamber 78 to the ambient atmosphere. In order to accommodate the thickness of the door 501 which is necessary, and to provide for the flush mounting of the access door 501 in the outer wall 503, a ridge 511 is required to be provided around the opening 505, to hold the door 501 in position when it is closed (FIG. 28). An alternative embodiment of the opening 605 is shown in FIG. 29, in which the door 501 is held in position by ribs 513 projecting inwardly around the opening 505.

Figure 30A:
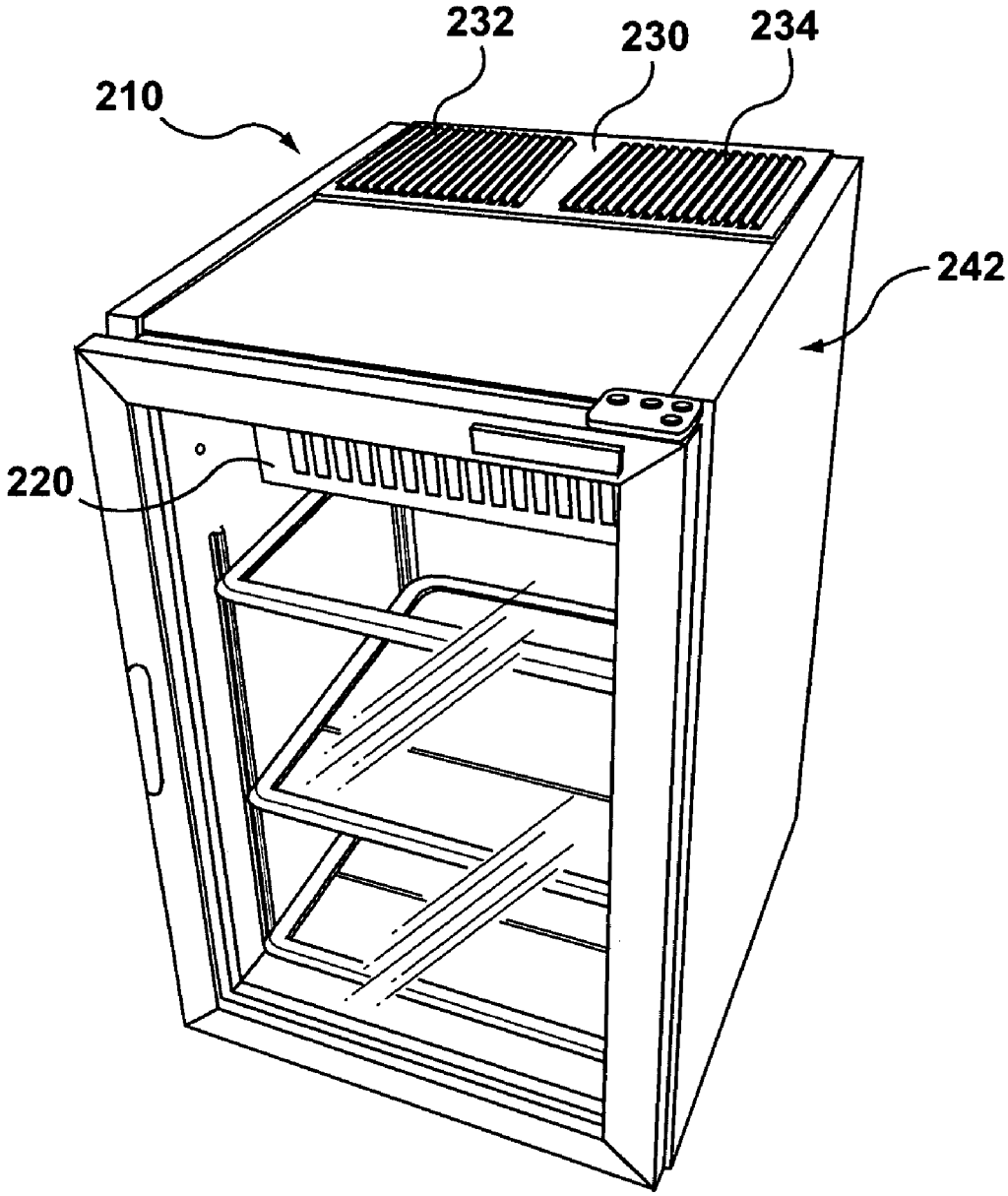
FIG. 30A is an isometric view of the front of an alternative embodiment of the refrigerator in which the modular refrigeration unit is top-mounted and back-loaded, drawn at a smaller scale.
Figure 30B:
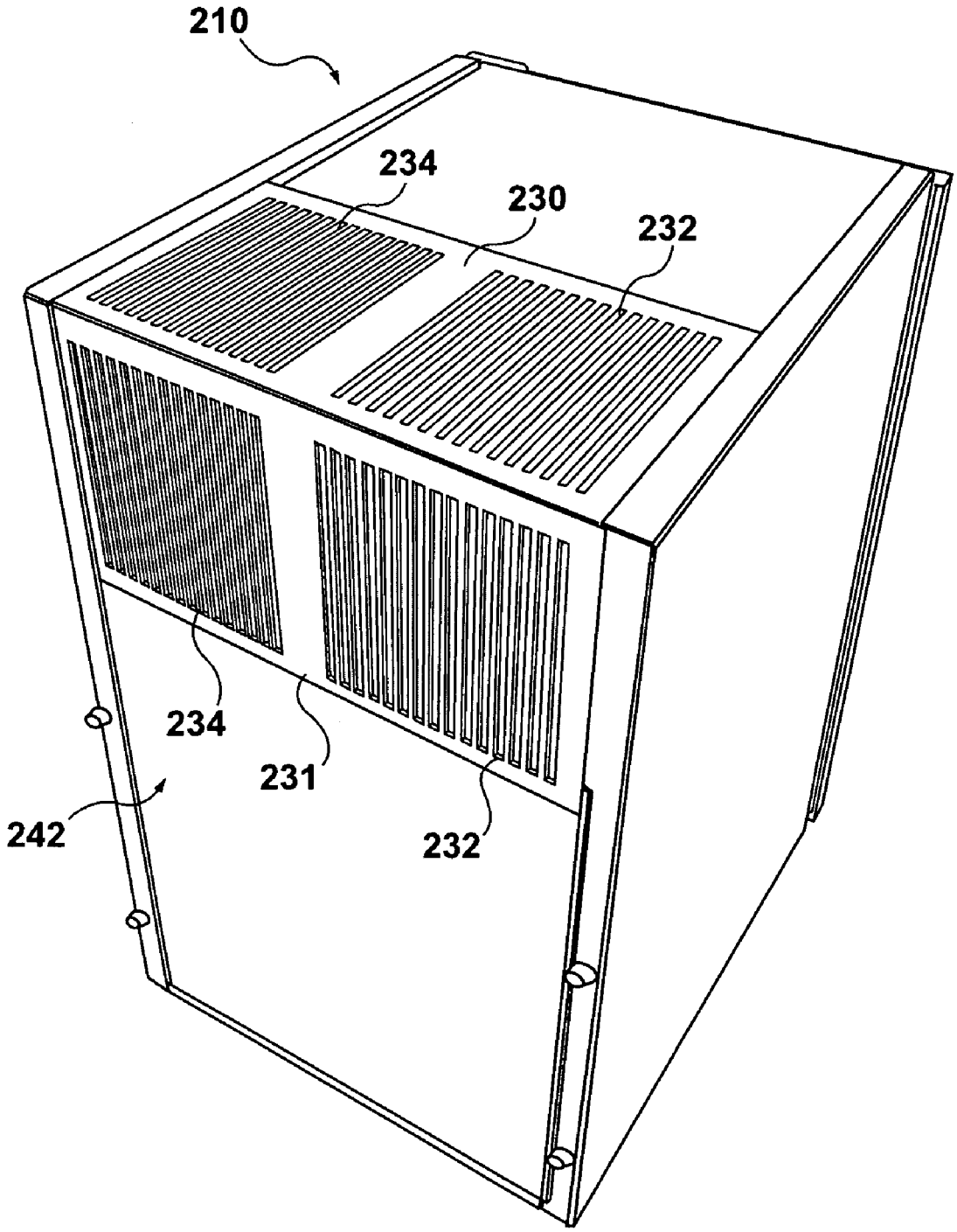
FIG. 30B is an isometric view of the back of the refrigerator of FIG. 30A.

Additional views of the alternative embodiment of the refrigerator 210 are shown in FIGS. 30A and 30B. As shown in FIG. 30A, the cabinet 242 includes a top grille 230 and, as shown in FIG. 30B, a back grille 231. Each of the top grille 230 and the rear grille 231 include intake louvers 232 and exhaust louvers 234. The louvers 232, 234 are positioned for air flow through the condenser chamber (right to left in FIG. 30B). It can also be seen in FIG. 30A that an evaporator shield 220 includes openings to permit air to flow into the evaporator 58.

Figure 31A:
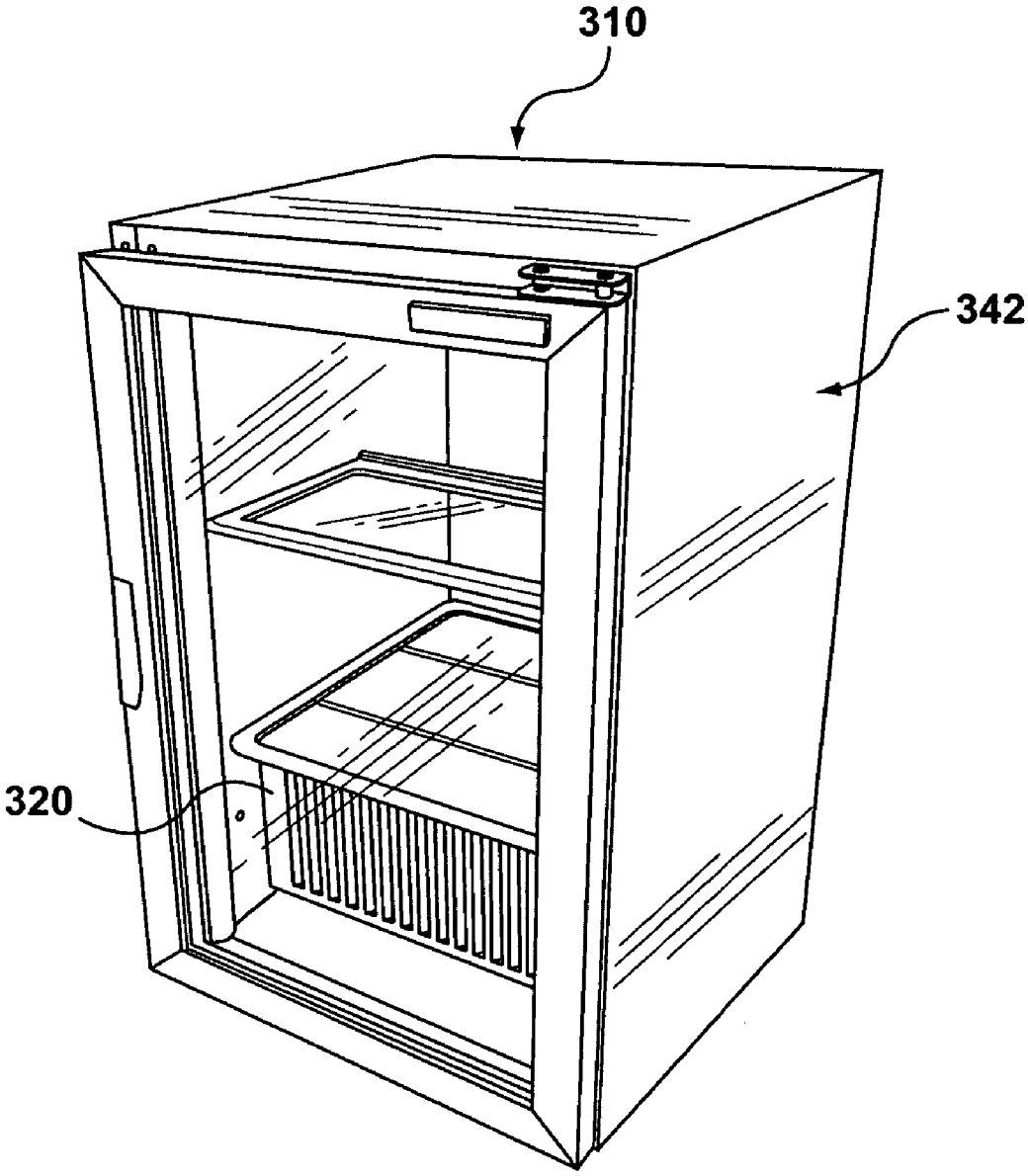
FIG. 31A is an isometric view of the front of another alternative embodiment of the refrigerator in which the modular refrigeration unit is bottom-mounted and back-loaded.
Figure 31B:
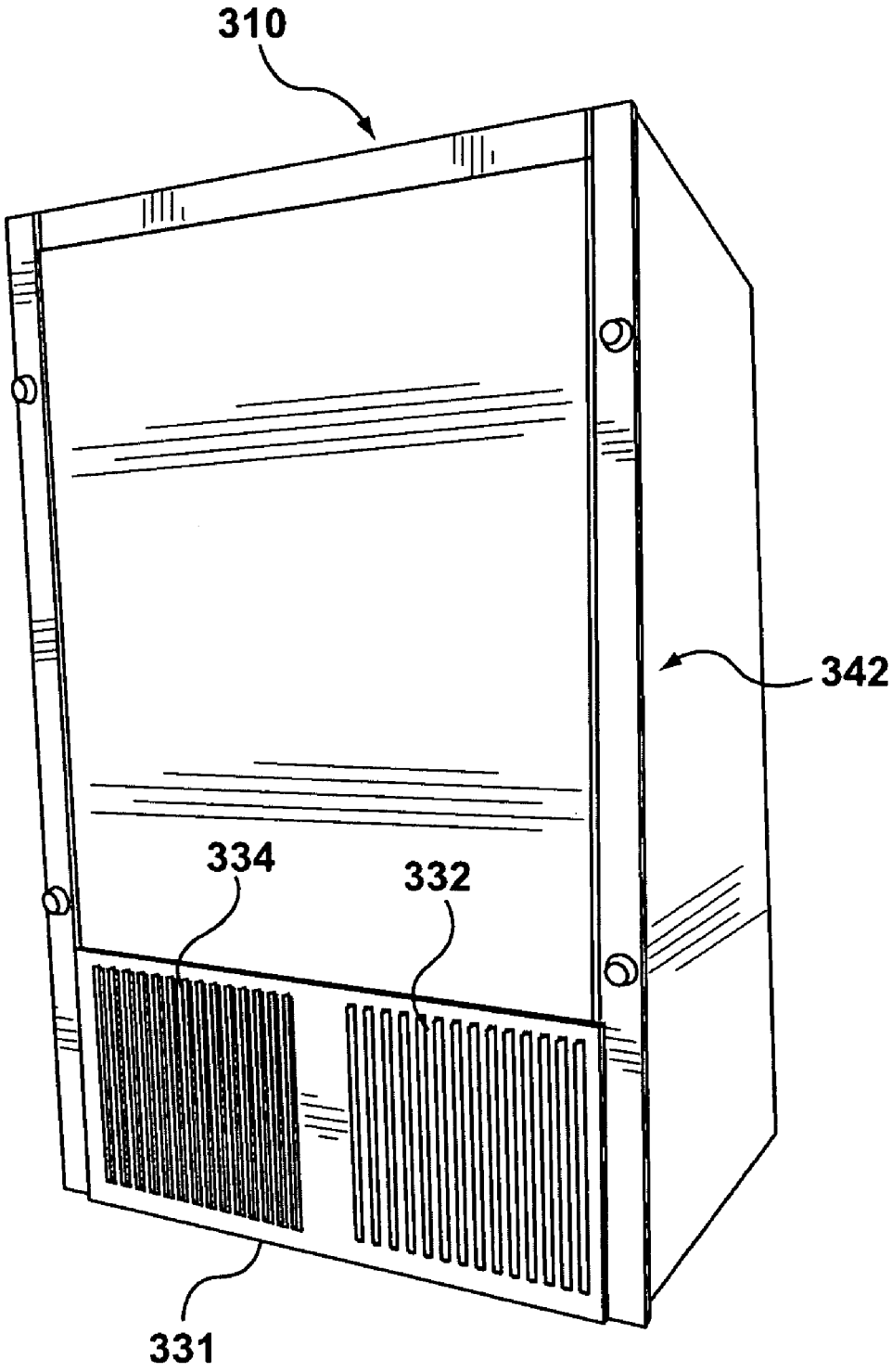
FIG. 31B is an isometric view of the back of the refrigerator of FIG. 31A.

The alternative embodiment 310 of the refrigerator is shown in FIGS. 31A and 31B. As can be seen in FIG. 31B, a grille 331 is attached to the cabinet 342 at a rear side thereof. The grille 331 includes intake louvers 332 and exhaust louvers 334, positioned for air flow through the condenser chamber (right to left in FIG. 31B). The shield 320 also includes louvers, to permit air to flow into the evaporator 58 (FIG. 31A).

Figure 32:
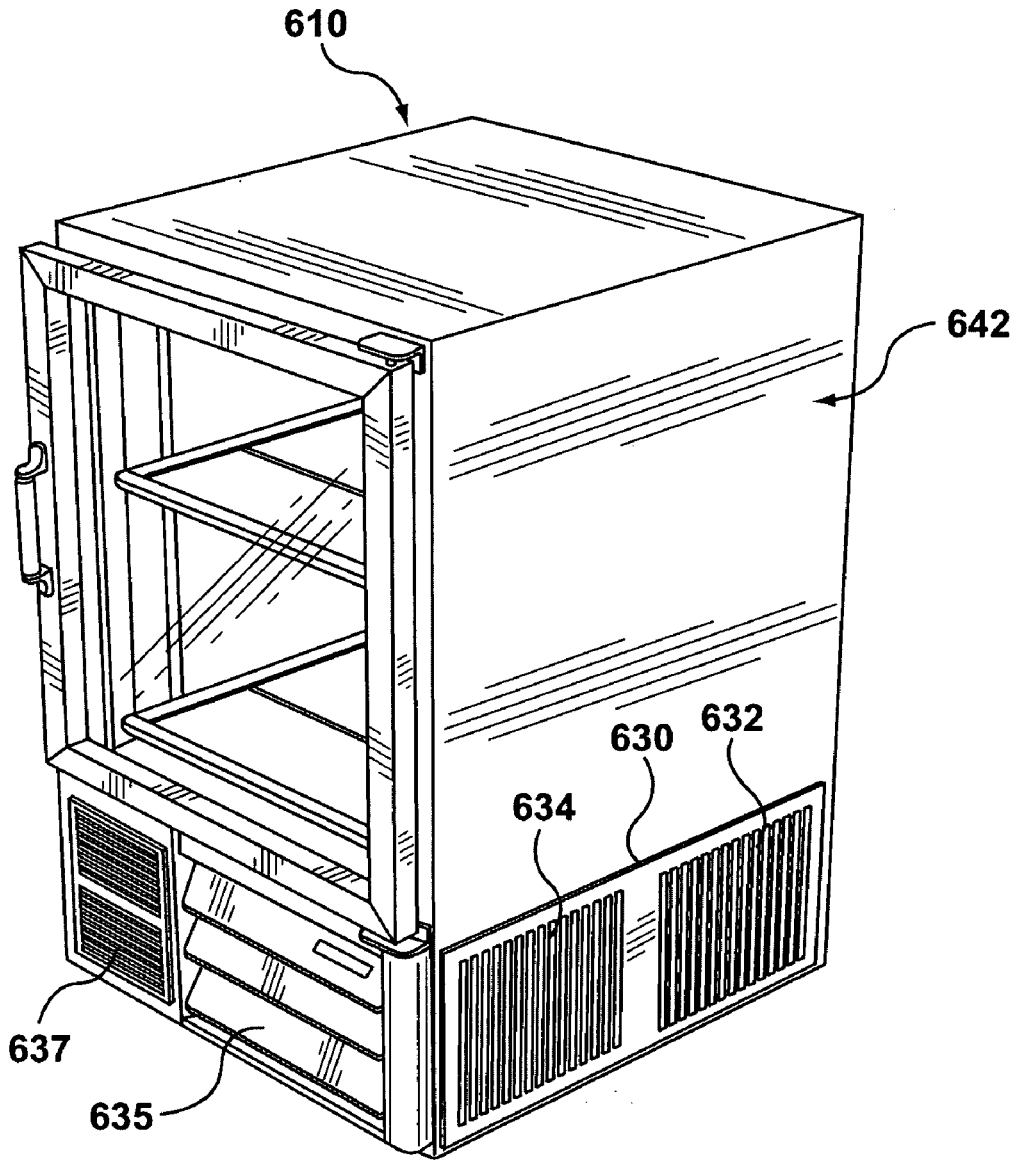
FIG. 32 is an isometric view of the front of another alternative embodiment of the refrigerator in which the modular refrigeration unit is bottom-mounted and loaded from the right side.

An alternative embodiment 610 of the refrigerator is shown in FIG. 32. The refrigerator 610 is a bottom-mounted, side-loaded model. A grille 630 is attached to the exterior of a cabinet 642. Preferably, the grille 630 includes intake louvers 632 and exhaust louvers 634. The additional louvers 635, 637 are not functional, and are provided simply to enhance the appearance of the refrigerator 610.

Figure 33A:
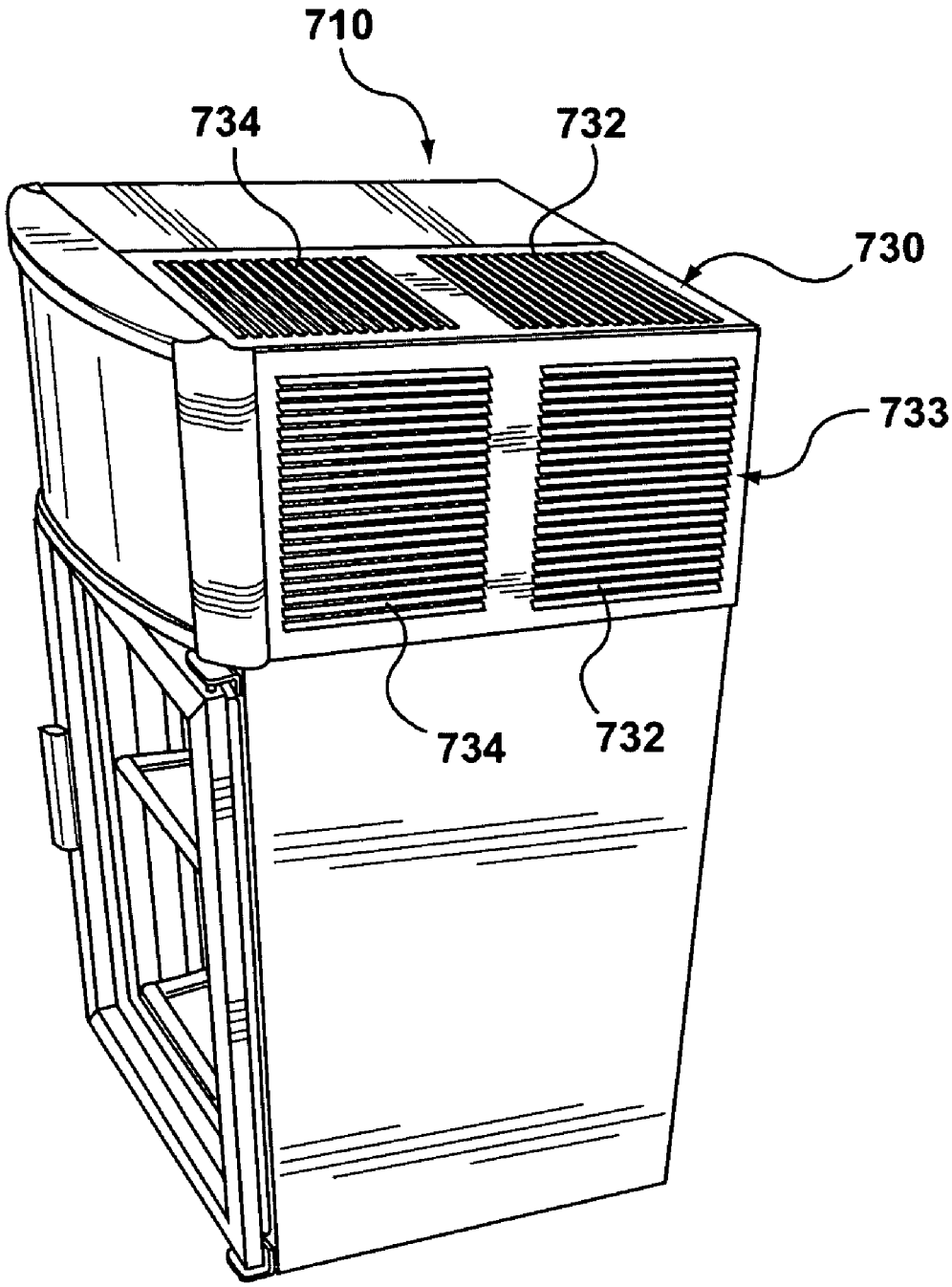
FIG. 33A is an isometric view of the front of another alternative embodiment of the refrigerator in which the modular refrigeration unit is top-mounted and loaded from the right side.
Figure 33B:
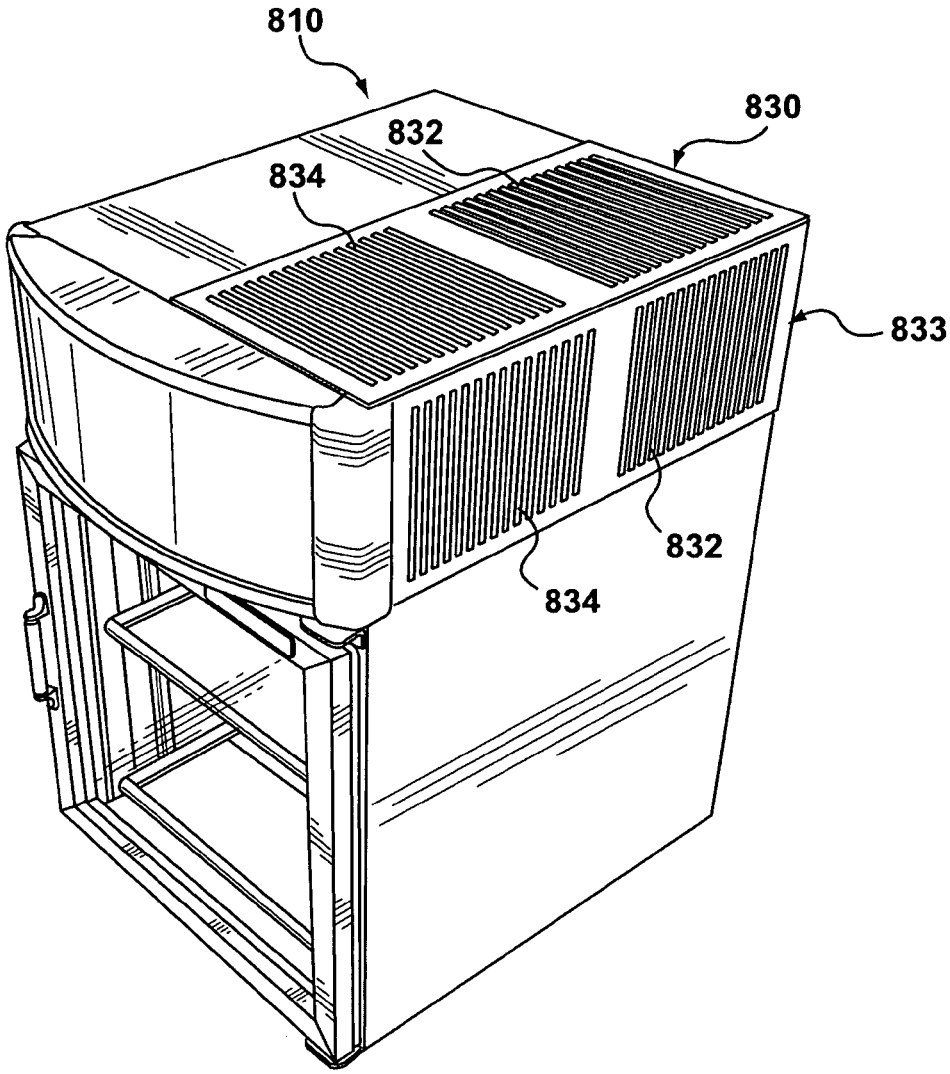
FIG. 33B is an isometric view of a counter-top version of the refrigerator of FIG. 33A.

Additional alternative embodiments 710, 810 of the refrigerator are shown in FIGS. 33A, 33B. FIG. 33A shows a top-mounted, side-loaded floor model, and FIG. 33B shows a top-mounted, side-loaded counter-top model. It will be appreciated by those skilled in the art that refrigerators in accordance with the invention may be constructed of different capacities as required by the ultimate user, i.e., as floor models or as counter-top models.

The refrigerator 710 shown in FIG. 33A includes a top grille 730 and a side grille 733. Each of the top grille 730 and the side grille 733 includes intake louvers 732 and exhaust louvers 734, positioned to guide air flow through the condenser chamber. In accordance with the preferred configuration of the modular refrigeration unit 40 (not shown in FIG. 33A), the direction of air flow through the condenser chamber would be from right to left in FIG. 33A. However, it will be appreciated by those skilled in the art that the direction of air flow could be from left to right, if the modular refrigeration unit were suitably configured.

Similarly, the refrigerator 810 shown in FIG. 33B includes a top grille 830 and a side grille 833, each of which includes intake louvers 832 and exhaust louvers 834.

It will be evident to those skilled in the art that the invention can take many forms, and that such forms are within the scope of the invention as claimed. Therefore, the spirit and scope of the appended claims should not be limited to the description of the preferred versions contained herein.

We claim:

1. A modular refrigeration unit for use in a refrigeration cabinet, the refrigeration cabinet including a condenser chamber having at least one insulated wall portion with at least one mating surface thereon and an insulated main chamber, said at least one mating surface defining an opening between the condenser chamber and the main chamber, the modular refrigeration unit comprising:

a condenser assembly comprising:
a condenser, for condensing a refrigerant therein;
a condenser fan, for directing a flow of air through the condenser,
to remove heat from the condenser;
a condenser fan motor to drive the condenser fan;
a compressor for compressing the refrigerant;
an evaporator assembly comprising:
an evaporator, for evaporating the refrigerant therein;
an evaporator tray positioned beneath the evaporator for collecting moisture condensed thereon;
an evaporator fan for directing a flow of air through the evaporator;
an evaporator fan motor to drive the evaporator fan;
the condenser assembly including a condenser tray for collecting and dissipating moisture condensed on the evaporator and directed to the condenser tray;
a bulkhead assembly positioned between the condenser assembly and the evaporator assembly, the bulkhead assembly including a periphery;
a gasket assembly coupled to one of said bulkhead periphery and said at least one mating surface; and
the bulkhead assembly being receivable in the opening upon movement of the modular refrigeration unit in a direction substantially transverse to the bulkhead assembly for engaging the gasket assembly with the other of said bulkhead periphery and said at least one mating surface to form a substantially air-tight seal between the condenser chamber and the main chamber.

2. A modular refrigeration unit according to claim 1 in which the gasket assembly comprises a gasket portion and a thermal breaker portion, the thermal breaker portion being mounted on the periphery of the bulkhead body portion.

3. A modular refrigeration unit according to claim 1 in which the gasket portion comprises at least three flexible vanes protruding outwardly from the periphery and adapted to engage with said at least one mating surface to form a substantially air-tight seal.

4. A modular refrigeration unit according to claim 3 in which the vanes comprise an elastomer.

5. A modular refrigeration unit according to claim 1 in which the condenser fan is positioned for creating a flow of air into the condenser chamber in a predetermined direction towards the condenser and the compressor, to cool the condenser and the compressor.

6. A modular refrigeration unit according to claim 5 in which the predetermined direction of said air flow directed towards the condenser and the compressor is substantially parallel to the bulkhead body portion.

7. A refrigerator comprising:
a refrigeration cabinet comprising insulated outer walls and at least one access door for accessing an insulated main chamber of the cabinet; the refrigeration cabinet comprising a condenser chamber extending inwardly from an aperture in an outer wall of the cabinet, the condenser chamber being at least partially defined by at least one insulated interior wall portion with at least one mating surface thereon, said at least one mating surface being positioned distal to the aperture, said at least one mating surface defining an opening between the condenser chamber and the main chamber;
a modular refrigeration unit installed in the cabinet, the modular refrigeration unit comprising:
a condenser assembly comprising:
a condenser for condensing a refrigerant therein;
a condenser fan, for directing a flow of air through the condenser, to remove heat from the condenser;
a condenser fan motor to drive the condenser fan;
a compressor for compressing the refrigerant;
an evaporator assembly comprising:
an evaporator, for evaporating the refrigerant therein;
an evaporator tray positioned beneath the evaporator, for collecting condensed moisture;
an evaporator fan for directing a flow of air through the evaporator;
an evaporator fan motor to drive the evaporator fan;
the condenser assembly comprising a condenser tray for collecting and dissipating moisture condensed on the evaporator and directed to the condenser tray;
a bulkhead assembly positioned between the condenser assembly and the evaporator assembly, the bulkhead assembly including a periphery, and a gasket assembly positioned around the periphery;
the bulkhead assembly being receivable in the opening upon movement of the modular refrigeration unit in a direction substantially transverse to the bulkhead assembly; and
the gasket assembly being engageable with said at least one mating surface to form a substantially air-tight seal between the condenser chamber and the main chamber when the bulkhead assembly is positioned in the opening.

8. A refrigerator according to claim 7 additionally comprising:
an evaporator shield assembly positioned in the main chamber for channelling a circulatory air flow in the main chamber through the evaporator;
a plenum positioned adjacent to the evaporator, for guiding the circulatory air flow along a predetermined circulatory air flow path; and
a partition positioned substantially vertically in the main chamber for directing at least a portion of the circulatory air flow toward the evaporator.

9. A refrigerator according to claim 8 in which the plenum and the partition partially define an interior chamber portion of the main chamber, the plenum and the partition comprising a plurality of openings formed to direct a predetermined volume of air following the circulatory air flow path into the interior chamber portion.

10. A refrigerator according to claim 7 in which said at least one insulated interior wall portion extends from the aperture in the outer wall to said at least one mating surface to form a condenser chamber floor on which the modular refrigeration unit is positioned when the bulkhead assembly is positioned in the opening.

11. A refrigerator according to claim 7 in which said at least one insulated interior wall portion extends from the aperture in the outer wall to said at least one mating surface to form a condenser chamber ceiling disposed above the modular refrigeration unit when the bulkhead assembly is positioned in the opening.

12. A refrigerator according to claim 7 in which said at least one mating surface comprises a thermal breaker.

13. A refrigerator according to claim 12 in which the thermal breaker forms a peripheral ledge positioned to engage the bulkhead assembly to form an air-tight seal.

14. A refrigerator according to claim 7 in which the gasket assembly comprises a gasket portion and a thermal breaker portion attached to each other.

15. A refrigerator according to claim 14 in which the bulkhead assembly includes a bulkhead body portion and the thermal breaker portion is mounted on the bulkhead body portion.

16. A refrigerator according to claim 14 in which the bulkhead assembly includes a bulkhead body portion and the thermal breaker portion is embedded in the bulkhead body portion.

17. A refrigerator according to claim 10 in which the aperture in the outer wall of the refrigeration cabinet extends above the condenser assembly, such that the flow of air directed through the condenser chamber flows towards the condenser and the compressor in a predetermined path.

18. A refrigerator according to claim 17 in which the refrigeration cabinet comprises a grille positioned above the condenser chamber, the grille comprising a first set of louvers positioned to guide the flow of air into the condenser chamber from the ambient atmosphere in the predetermined path, a second set of louvers positioned to guide the flow of air out of the condenser chamber in the predetermined path and to substantially prevent immediate recirculation of air into the condenser chamber.

19. A refrigerator according to claim 7 in which the refrigeration cabinet comprises a secondary access door positioned in a substantially planar second outer wall of the cabinet for accessing the main chamber, the secondary access door being movable between an open position and a closed position, the second outer wall of the cabinet comprising an opening for receiving the secondary access door such that, when the secondary access door is in the closed position, an exterior surface of the secondary access door is substantially flush with an external surface of the second outer wall.

20. A refrigerator according to claim 19 in which the second outer wall comprises a ridge projecting into the opening, the ridge being spaced back from the external surface of the second outer wall to permit the exterior surface of the secondary access door to be substantially flush with the external surface of the second outer wall when the secondary access door is in the closed position.

21. A refrigerator according to claim 20 in which the second outer wall has a predetermined thickness of insulation therein and the secondary access door has a thickness of insulation substantially equivalent thereto, for insulating the main chamber from the ambient atmosphere.

22. A gasket assembly for use with a mating surface including a first thermal breaker portion in a refrigeration cabinet, the gasket assembly comprising:

a second thermal breaker portion adapted for attachment to a bulkhead body portion around a periphery thereof; and a flexible gasket portion attached to the second thermal breaker portion, the gasket portion being adapted to engage with the mating surface on at least one internal wall portion surface of the refrigeration cabinet such that the gasket portion is positioned between the first and second thermal breaker portions to form a substantially air-tight seal.

23. A modular refrigeration unit for use in a refrigeration cabinet, the refrigeration cabinet including a condenser chamber having at least one insulated wall portion with at least one mating surface thereon and an insulated main chamber, said at least one mating surface defining an opening between the condenser chamber and the main chamber, the modular refrigeration unit comprising:

a condenser assembly;

an evaporator assembly;

a bulkhead assembly positioned between the condenser assembly and the evaporator assembly, the bulkhead assembly having a periphery engageable in said opening between the condenser chamber and the main chamber;

a gasket assembly coupled to one of said bulkhead periphery and said at least one mating surface; and the modular refrigeration unit being adapted for movement substantially transverse to the bulkhead assembly for engaging the gasket assembly with the other of said bulkhead periphery and said at least one mating surface to form a substantially air-tight seal between the condenser chamber and the main chamber.

24. A modular refrigeration unit according to claim 23 in which the gasket assembly includes a bulkhead thermal breaker portion mounted onto the bulkhead periphery and a plurality of flexible vanes extending outwardly from the bulkhead thermal breaker portion, the modular refrigeration unit being adapted for movement into the opening in a direction substantially transverse to the bulkhead body portion for engaging the vanes with said at least one mating surface to form a substantially air-tight seal between the condenser chamber and the main chamber.

25. A refrigerator comprising:

a refrigeration cabinet comprising insulated outer walls and at least one access door for accessing an insulated main chamber of the cabinet;

the refrigeration cabinet comprising a condenser chamber extending inwardly from an aperture in an outer wall of the cabinet, the condenser chamber being at least partially defined by at least one insulated interior wall portion with at least one mating surface thereon, said at least one mating surface being positioned distal to the aperture, said at least one mating surface defining an opening between the condenser chamber and the main chamber;

a modular refrigeration unit installed in the cabinet, the modular refrigeration unit comprising:

a condenser assembly;

an evaporator assembly;

a bulkhead assembly positioned between the condenser assembly and the evaporator assembly, the bulkhead assembly having a periphery engageable in said opening between the condenser chamber and the main chamber;

a gasket assembly coupled to one of said bulkhead periphery and said at least one mating surface; and the modular refrigeration unit being adapted for movement substantially transverse to the bulkhead assembly for engaging the gasket assembly with the other of said bulkhead periphery and said at least one mating surface to form a substantially air-tight seal between the condenser chamber and the main chamber.

26. A refrigerator according to claim 25 in which the gasket assembly includes a bulkhead thermal breaker portion mounted onto the bulkhead periphery and a plurality of flexible vanes extending outwardly from the bulkhead thermal breaker portion, the modular refrigeration unit being adapted for movement into the opening in a direction substantially transverse to the bulkhead body portion for engaging the vanes with said at least one mating surface to form a substantially air-tight seal between the condenser chamber and the main chamber.

27. A refrigerator according to claim 25 additionally comprising:

an evaporator shield assembly positioned in the main chamber for channelling a circulatory air flow in the main chamber through an evaporator in the evaporator assembly;

a plenum positioned adjacent to the evaporator, for guiding the circulatory air flow along a predetermined circulatory air flow path; and a partition positioned substantially vertically in the main chamber for directing at least a portion of the circulatory air flow toward the evaporator.

28. A refrigerator according to claim 18 additionally comprising a third set of louvers positioned in a front panel assembly, the third set being adapted to guide a flow of ambient air in a predetermined direction into the condenser chamber, such that immediate recirculation of air exiting the condenser chamber from the exhaust louvers is substantially prevented.

* * * * *